US008474226B2

(12) United States Patent
Izquierdo et al.

(10) Patent No.: US 8,474,226 B2
(45) Date of Patent: Jul. 2, 2013

(54) THERMAL SEALING PACKAGING SYSTEMS AND METHODS FOR THERMAL SEALING PACKAGING

(75) Inventors: Eneko Izquierdo, Oñati (ES); Takashi Katayama, Tokyo (JP)

(73) Assignees: Ulma Packaging Technological Center, S. Coop., Onati (ES); Teraoka Seiko Co., Ltd., Ohta-Ku, Tokyo (JP)

( * ) Notice: Subject to any disclaimer, the term of this patent is extended or adjusted under 35 U.S.C. 154(b) by 320 days.

(21) Appl. No.: 12/847,855

(22) Filed: Jul. 30, 2010

(65) Prior Publication Data

US 2011/0023421 A1 Feb. 3, 2011

(30) Foreign Application Priority Data

Jul. 30, 2009 (JP) ..... 2009-177852

(51) Int. Cl.
*B65B 51/10* (2006.01)

(52) U.S. Cl.
USPC ..... 53/389.2; 53/51; 53/67; 53/282; 53/498; 493/11; 493/15; 493/18

(58) Field of Classification Search
USPC ..... 53/51, 57, 58, 64, 389.2, 67, 75, 53/76, 282, 329.4, 498, 499, 500; 493/11, 493/13, 14, 15, 17, 18
See application file for complete search history.

(56) References Cited

U.S. PATENT DOCUMENTS 3,029,007 A * 4/1962 Hepner ..... 226/173
3,238,691 A * 3/1966 Miller et al. ..... 53/396
3,490,196 A * 1/1970 Sorensen ..... 53/51
3,650,773 A * 3/1972 Bush et al. ..... 426/383
3,662,511 A * 5/1972 Eliasberg ..... 53/411
3,673,760 A * 7/1972 Canamero et al. ..... 53/433
4,655,026 A * 4/1987 Wigoda ..... 53/55
4,951,444 A * 8/1990 Epstein et al. ..... 53/77
5,966,908 A * 10/1999 Philipp et al. ..... 53/450
6,021,629 A * 2/2000 Sterner, Sr. ..... 53/471
6,571,530 B1 * 6/2003 Hikita et al. ..... 53/53
6,769,231 B2 * 8/2004 Danby ..... 53/473
7,100,345 B2 * 9/2006 Send ..... 53/51
7,603,831 B2 * 10/2009 Sperry et al. ..... 53/450
7,762,301 B2 * 7/2010 Mathea ..... 156/378
7,896,792 B2 * 3/2011 Natterer ..... 493/62
8,122,686 B2 * 2/2012 Kollmuss ..... 53/411
2001/0047638 A1 * 12/2001 Schmidt et al. ..... 53/51

FOREIGN PATENT DOCUMENTS

JP 07315310 A 12/2005

* cited by examiner

*Primary Examiner* — Hemant M Desai
(74) *Attorney, Agent, or Firm* — Tim L. Kitchen; Peter B. Scull; Hamilton, DeSanctis & Cha, LLP

(57) ABSTRACT

A thermal seal packaging systems and methods thereof. In one implementation a thermal sealing packaging system has a container transfer unit for transferring a container which is to contain a package item, a measuring unit for measuring the weight of the item that is loaded in the container being transported before it is loaded into the container, a capping film supply unit for a capping film to cover the opening area of the container, an indication means for indicating the measurement data of the measurement unit on the capping film, and a sealing unit for heat-sealing an opening area of the container, into which the package item is loaded, with the capping film, the opening area of the container into which the item is loaded is covered by the capping film on which the corresponding measurement data is indicated.

9 Claims, 16 Drawing Sheets

(a)
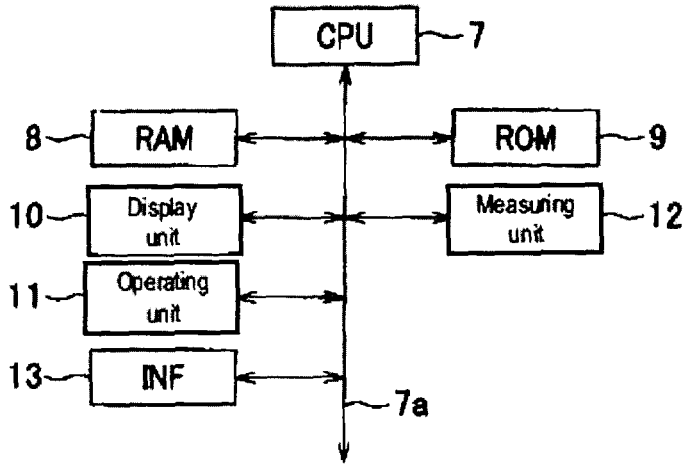
(b)
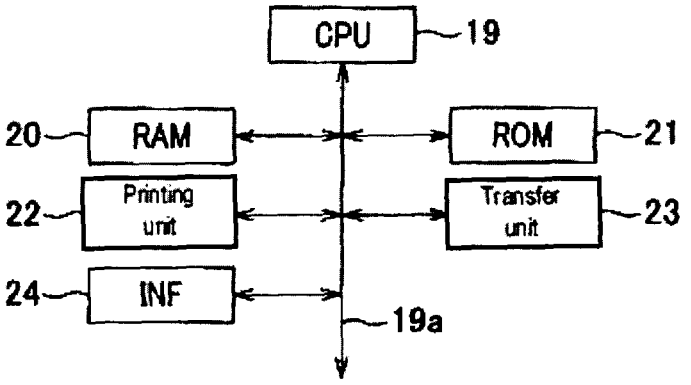
Fig. 7

(a)

Merchandise file

| Product number | Product name | Unit price | Additives | ··· |
|---|---|---|---|---|
| ⋮ | ⋮ | ⋮ | ⋮ | ⋮ |
| 0005 | OOOO | 250 | 1 | ··· |
| ⋮ | ⋮ | ⋮ | ⋮ | ⋮ |

(b)

Packaging machine RAM

| | | | |
|---|---|---|---|
| ⋮ | | | |
| LED number 1 | 1 | Object detection signal 1 | 1 |
| LED number 2 | 1 | Object detection signal 2 | 1 |
| Object count number | | | |
| ⋮ | | | |

(c)

Scale RAM

| | |
|---|---|
| ⋮ | |
| Merchandise file | |
| Readout product number | |
| Assignment 1 (LED number 1) | weight |
| Assignment 2 (LED number 2) | weight |
| Prior 1 (LED number 1) | weight |
| Prior 1 (LED number 2) | weight |
| Weight history | |
| ⋮ | |

Fig. 15

THERMAL SEALING PACKAGING SYSTEMS AND METHODS FOR THERMAL SEALING PACKAGING

CROSS-REFERENCE TO RELATED APPLICATIONS

The present application relates to and claims the benefit of Japanese Patent Application No. 2009-177852 filed Jul. 30, 2009.

FIELD

The present invention is related to thermal sealing packaging systems intended to package by loading an item to be packed (hereinafter referred to as "package item") in a container (a cavity part), and to cover an opening of the container with a capping film.

BACKGROUND

A thermal sealing device is already known from the unexamined Japanese Patent Application H7-315310, where a film is warmed with a heater plate, a container (a cavity part) is molded by pressing the warmed film into a mold with compressed air, a package item is load in the container, the container's opening is covered with a capping film in a downstream stage, and the capping film's periphery is thermally sealed onto the container to complete the packaging process. However, it is impossible to measure the weight of the package item, whose weight is not uniform, during the packaging process. Therefore, it is usual to measure the weight of the product, including the container, after packaging it, to take the weight of the container away from the weight to calculate the weight of the package item, to print the calculated weight onto a label, and to stick the label on the container.

However, sticking the label after completing the packaging as described above in a prescribed position can be difficult, since it is possible that a portion of the top surface (capping film) of the heat-sealed container protrudes upwardly as the size and shape of the package item vary. Moreover, when a guide member is used to control the position of the container when the container is transferred by a conveyor, in order to control the label sticking position on the top surface of the container in case of sticking the label after completion of the packaging process as described above, the capping film and the container itself wrapped by the capping film may be soft, so that the container may not be able to be controlled to be transferred to the desired position even if the container comes in contact with the guide member, consequently causing a problem that it is difficult to stick the label printed with a weight on a uniform position of the package item after completion of the packaging process.

SUMMARY

The present invention is intended to solve the aforementioned problem existing in the packaging technology of known prior art, and its task is to provide a thermal sealing packaging device and a method for thermally sealing a package capable of securely showing measurement information of the package item at a specified location of the thermally sealed package.

In order to accomplish the aforementioned task, in one implementation a thermal sealing packaging system is provided that comprises a container transfer unit for transferring a container adapted for containing a package item; a measuring unit for measuring the weight of the package item that is loaded in the container before it is loaded into the container; a capping film supply unit for supplying a capping film to cover the opening area of the container; an indication means for indicating the measurement data of the measurement unit on the capping film; and a sealing unit for thermal-sealing an opening area of the container, into which the package item is loaded, with the capping film, wherein the opening area of the container, into which the item is loaded, is covered by the capping film on which the corresponding measurement data is indicated. The container transportation by the container transfer unit can be either in a format of transferring a container film, molding the container film while it is being transferred into a container (cavity part) shape with a certain interval using a mold, and transporting the container, or in a format of supporting and transferring a preformed container with a transport unit. Moreover, the container transport unit can be arranged in any arbitrary way, e.g., single row and multiple rows (double, triple rows, etc.).

The measurement of the weight of the package item only needs to be done before the package item is loaded into the container, and does not require any particular location for the measurement unit. For example, if a particular supply unit is specified for loading the package item into a container that is transferred by the container transfer unit that comprises the thermal sealing packaging device, the measurement unit can be located either on the upstream side of the particular supply unit or in the vicinity of the supply unit. The measurement unit does not have to be limited to one, but rather a plurality of measurement units can be used as well.

A supply unit for the capping film can be constituted in such a way as to rotatably support a film that is wound in a roll shape, and to cause the capping film to be fed as a result of the transfer of the container, because it is thermally sealed on the top opening of the container in the sealing unit located on the downstream side, or to have a separate drive unit, independent from the container transfer unit, and to synchronize its drive with that of the container transfer unit, or to have a timing offset between the transfer of the container containing the measured package item and the transfer of the capping film on which the measurement data is indicated, or in other ways; in any event, the film printed with the weight of the item is thermally sealed on the container in the sealing unit while it is properly matched with the particular item.

The indication means is intended to indicate the measurement data available from the measurement unit as well as the product data of the package item on the capping film, and its indication method can be either a direct indication method of printing the data directly on the capping film, or an indirect indication method of printing the data on a label and sticking the label on the capping film.

The direct indication method can be accomplished by typing specified items on the capping film by applying heat on ribbon ink with a thermal head or printing the same with an ink jet method. The items to be printed include information defined in a product file referred to a specific product number that specifies the package item (e.g., product name, unit price, additives, etc.) and the measurement data from the measurement unit.

A sealing unit is intended to complete a package by thermally fusing the capping film on the opening of the container containing the package item, and its packaging method can be either an air-filled packaging (to cover the top opening of a container transferred to a sealing mold with a capping film, thermally fusing the periphery of the capping film), a vacuum packaging (to cause a vacuum state by sucking out air of the container inside the sealing mold, and thermally fusing the periphery of the capping film), or a gas-filled packaging (to cause a vacuum state by sucking out air of the container inside the sealing mold, and to inject a gas (oxygen, carbon dioxide, nitrogen, etc.) to improve the environment inside the container).

According to the above means, the package item is loaded into the container to be transferred by the container transfer unit after the package item is measured at the measurement unit, and then the container containing the package item is transferred to the sealing unit by the container transfer unit. The measurement value obtained by the measurement unit is transmitted to the indication means located on the transfer route of the capping film upstream of the sealing unit, the measurement data and product information being indicated (printed or labeled) on the capping film by means of the indication means. The opening of the container containing the package item is covered with the capping film, on which the measurement data and product information of the item contained in the container are indicated, and the capping film is thermally sealed on the container to complete the packaging. Therefore, the cap of the container can indicate securely the product information also including the measurement data of the packaging item contained. After the packaging is completed, any unnecessary part of the film is cut off from the seal unit in a cutting unit located in the downstream.

A supply unit for loading a package item into the container can be constituted in such a way that it receives a plurality of containers from the container transfer unit and is provided with a container assignment unit for assigning a particular container for each measured packaging item, and for storing indication position information for indicating the measurement data on the capping film in correspondence with each container assignment unit. The container assignment unit can be based on either a method of assigning a container by lighting a LED placed beneath the container, a method of irradiating the container with a lamp placed above it, a method of placing shutters (rotating top to bottom, sliding horizontally, etc.) and opening only a shutter located above the container to which the package item is loaded, or other methods.

According to the above means, a user can work more efficiently as he doesn't have to think to which one of the containers he has to load the package item because the container, to which the item needs to be loaded in the supply unit after it is measured, is indicated clearly. Moreover, since the indication position information corresponding to each container assignment unit is stored, the measurement data of a package item is indicated on the cap of the particular container securely by simply loading the item to the assigned container. Further, a package item detection unit for detecting whether a container is loaded with a package item or not can be provided in the vicinity of the container detection unit. The package item detection unit can be based on either a method of detecting with a sensor whether or not the hand holding the package item is located above the opening of the container, a method of taking a picture of the container from above and judging from the picture, or other methods. In this case, it is constituted in such a way that the assignment of the container assignment unit is canceled based on the detection signal of the package item detection unit. According to the means, it can be judged securely whether or not the package item is loaded in the assigned container, while the container to which the item to be loaded is assigned by the container assignment unit provided in the supply unit.

The assignment cancellation of the container assignment unit can be canceled when the loading of the package item to the assigned container is detected by the package item detection unit. However, in a case where one unit of package item consists of several blocks, for example blocks of meat, it can happen that not all the meat pieces (blocks) are loaded into the container from the measurement unit (measurement tray), but rather loaded in two or three portions. In such a case, if the instruction is canceled mistakenly based on a judgment that the entire product is loaded at the first load and the container is moved toward the sealing unit, it can result in packaging of a partially loaded product. In order to prevent such a problem, the system can be constituted in such a way that the next process is executed only when it is detected that the entire amount of the package item placed on the measurement unit is removed in addition to the detection signal of the package item detection unit. The next process means either the process of turning off the light of the container assignment unit, or assigning the next operation without turning off the light of the container assignment unit, or transferring the film when one row of products are loaded, etc.

The detection (judgment) of whether or not the entire amount of package item is removed from the measurement unit (measurement tray) can be made either by detecting that the measurement value is "0" or by judging the picture taken of the measurement tray of the measurement unit, etc.

The container into which the measured package item is loaded does not necessarily be constituted to be assigned by the container assignment unit provided at the supply unit. For example, the system can be constituted in such a way as to have a measurement data storage unit for storing measurement data outputted by the measurement unit, wherein the outputted measurement data is stored in conjunction with the detection information from the package item detection unit recognized when the package item is loaded into the container. The package item detection unit is intended for detecting to which container among the containers located in the supply unit the package item is loaded, and it is based on either a method of detecting the operator's action involved in gripping the item in order to load it into the container, i.e., detecting the hand holding the item being positioned over the opening of the container by a sensor, or a method of taking a picture of the container from above and judging from the picture, or other methods.

According to the above means, the operator can freely select the container to load the package item, and the location of the container can be identified as the loaded container is detected by the package item detection unit. The location information and the measurement date of the package item are stored in conjunction. The data indicated on the capping film by the indication means is indicated securely on a responding position of the capping film that encloses the opening of the container to which the package item is loaded.

Furthermore, the system can be constituted in such a way as to have an error reporting unit for reporting an error when the package item is loaded mistakenly into a container different from the container assigned by the container assignment unit. The error reporting unit can be a buzzer, an error reporting lamp, or others.

Since an error signal is issued if the package item is loaded mistakenly into a container different from the assigned container, according to the means, it prevents a wrong measurement data from being indicated on the capping film of the container to which the item is loaded. In other words, it prevents errors on the corresponding relation between the container to which the package item is loaded and the product information including the measurement data to be indicated on the capping film of the particular container.

The system can also be constituted in such a way that the transfer of the container by the container transfer unit and the supply of the capping film by the capping film supply unit are intermittently driven, and the indication on the capping film by means of the indication means is executed when the package item is loaded into the container when it is stopped as mentioned above using the measurement data of the item measured by the measurement unit prior to the loading of the item into the container. The measurement data of the item to be indicated by the indication means, which is the measurement data of the item measured prior to the item currently being loaded into a container of the supply unit, can be either the measurement data of the item one piece before (immediately before) the item currently being loaded into the container, or the measurement data of the item two pieces or more before, etc. However, it may be preferable that the supply (transport) of the capping film be driven separately from the container transfer means if the measurement data of the two pieces or more before is to be indicated.

According to the above-mentioned means, thermal seal packaging can be done efficiently in a shorter time, as the indication (printing or label sticking) can be completed while a previous package item is measured and loaded in a container, so that the capping film is transferred for loading of the next package item without having to wait, and the measurement data of the item previously measured is printed using the time the film is stopped for loading the item, thus eliminating the need to wait at least in measuring and loading a first product until the indication of the measurement data of the particular product is completed.

Moreover, in one implementation the method of thermal seal packaging is a method of where the container to contain the package item and the capping film for covering the opening of the container are transferred separately, the opening of the container being covered by the capping film at the packaging stage after the package item is loaded into the container, and the periphery of the capping film being thermally sealed, the method comprising a measuring process for measuring the weight of the item prior to the loading of the item into the container, and an indicating process for indicating the measurement data obtained in the measuring process on the capping film to be supplied to the packaging stage, wherein the capping film indicated with the measurement data is controlled to cover the opening of the particular container containing the corresponding item respectively. The transfer of container and capping film can be done either synchronously or not.

The measuring process can be done so long as the package item is loaded into the container and the location of measurement (location of measurement unit) is preferably on the container transfer line or the side of the container transfer line in consideration of loading the item into the container after the measurement.

The indicating process can be based on a method of directly printing the product information including the measurement data on the capping film by the printer, or a method of printing the product information including the measurement data on a label, and sticking the label on the capping film.

According to the above-mentioned means, it is possible to indicate the product information including the measurement data neatly on a specified location on the capping film, as the weight of the package item is measured prior to loading the item into the container, its measurement data being indicated on the capping film for covering the opening area of the container before thermically sealing it, and the capping film with the product information including the measurement is thermically sealed in correspondence with the container containing the particular item.

The system can also be constituted in such a way that the container and the capping film that encloses the opening of the container are transferred intermittently in synchronization, and that the measuring process of measuring and loading the package item and the indicating process of indicating the measurement data of the item measured in the previous step on the capping film are executed in the same step in which the container and the capping film are both stopped in each step of transfer.

In case of molding the container during the process of transferring the container film, the system is constituted in such a way that the container and the capping film that encloses the opening of the container are transferred intermittently in synchronization, and that the molding process of molding the container on the container film, the measuring process of measuring and loading the package item, the indicating process of indicating the measurement data of the item measured in the previous step on the capping film, and the sealing process for enclosing the opening of the container containing the item with the capping film and thermically sealing together are executed in the same step in which the container and the capping film are both stopped in each step of transfer.

According to the above-mentioned means, thermal seal packaging can be done efficiently in a shorter time, as the indication (printing or sticking of a label printed with the measurement data) of the measurement data of the measured item in a previous cycle is executed using the time the container is stopped for measuring and loading the package item, thus eliminating the need to wait at least in measuring and loading a first product until the indication of the measurement data of the particular product is completed.

Implementations of the invention disclosed and herein possess, among others, one or more of the following advantages: (a) the capability to securely indicate a product information, including weight, on a specified location of the capping film that encloses the opening of the container; (2) the ability of a user to work more efficiently as he doesn't have to think to which one of the containers he has to load the package item because the container, to which the item needs be loaded, is clearly indicated. Moreover, since the indication position information corresponding to each container assignment unit is stored, the measurement data of a package item is indicated on the cap of the particular container securely by simply loading the item to the assigned container; (3) the ability to determine if the package item is surely loaded into the assigned container or not can be securely judged as described in claim 3. Thus, packaging errors can be securely prevented; (4) a correct packaging becomes possible as it prevents erroneously proceeding to the next process after loading only a portion of the product placed on the weighing dish, as it makes a judgment that the package item placed on the weighing dish is completely removed to be loaded in the container before proceeding to the next process; (5) data indicated on the capping film by the indication means is indicated securely on a responding position of the capping film that encloses the opening of the container to which the package item is loaded. Thus, it prevents a problem of a mismatch between the item contained in the container and the indication contents indicated on the capping film of the container; (6) the prevention or reduced possibility of a mismatch between the container being loaded with the package item and the product information including the measurement data indicated on the capping film enclosing the opening of the particular container, since an error signal is issued if a mistake occurs in the loading position; (7) thermal seal packaging can be done efficiently in a shorter time, as the indication of the measurement data of the package item measured in a previous cycle is executed using the time the film (or the container) is stopped for loading the package item this time, thus eliminating the need to wait at least in measuring and loading a first product until the indication of the measurement data of the particular product is completed; (8) the ability to indicate neatly the product information including the measurement data at the specified location of the capping film in thermal seal packaging; and (9) thermal seal packaging can be done efficiently in a shorter time, as indicating of the measurement data of the package item measured in a previous cycle, thermal sealing of the container and the capping film, and molding of the container are executed using the time the container is stopped for loading the package item this time, thus eliminating the need to wait at least in measuring and loading a first product until the indication of the measurement data of the particular product is completed.

BRIEF DESCRIPTION OF THE DRAWINGS

FIG. 7 (*a*) is an electrical block diagram of a measurement unit and (*b*) is an electrical block diagram of an indication means.

FIG. 15 (*a*) is a diagram showing the constitution of a product file, (*b*) is a diagram showing a storage content of a RAM used in a packaging machine, and (*c*) is a diagram showing a storage contents of a RAM used in a measurement unit.

DETAILED DESCRIPTION

Embodiments of a thermal sealing packaging system according to the present invention are described below, with reference to the accompanying Figures. In the embodiments a device is described wherein a container (cavity part) is formed using a mold during the process of transferring the container film, a package item is loaded into the container, the opening of the container is covered with a capping film, and the capping film is thermally sealed to the container to complete a packaging process.

Figure 1:
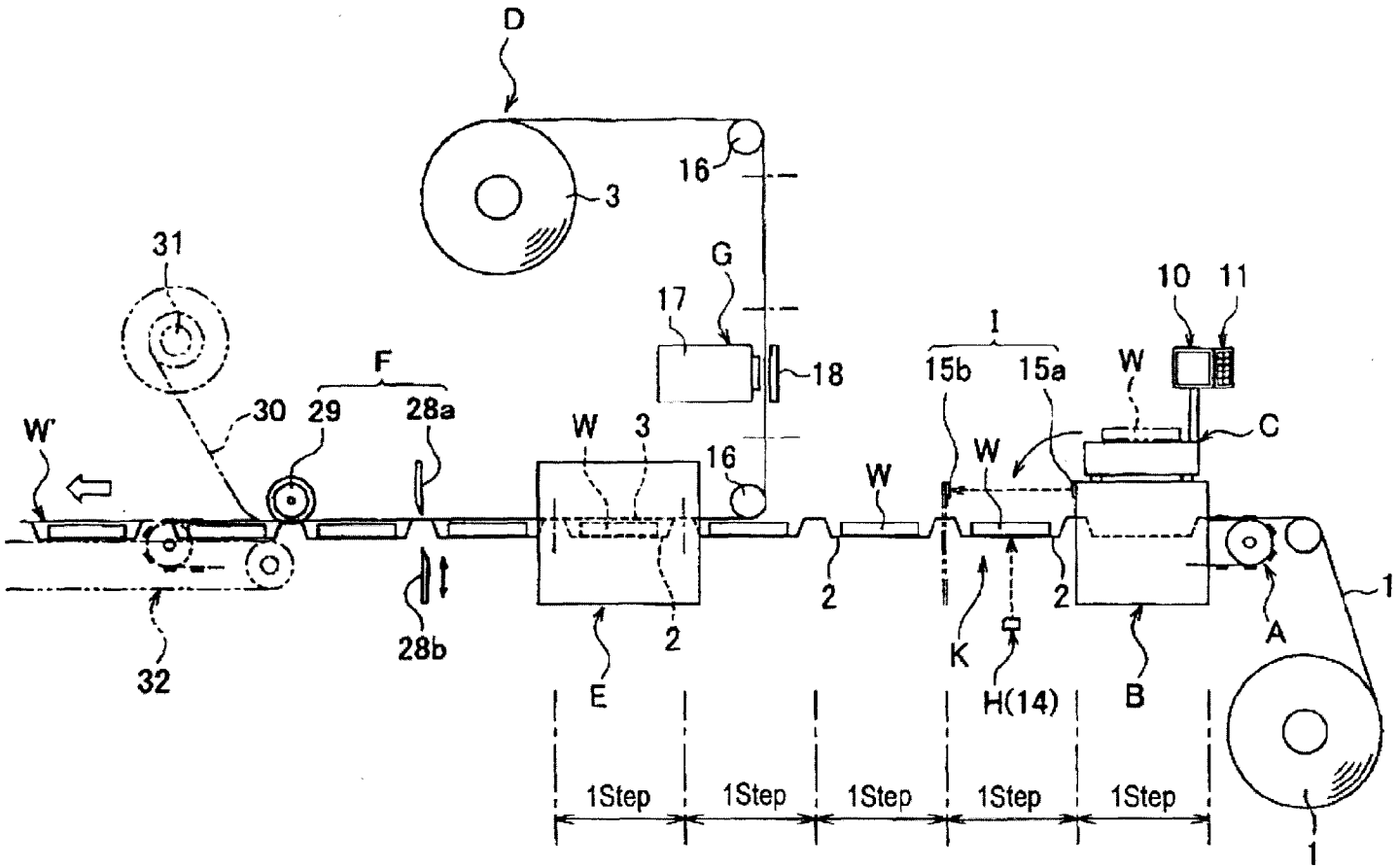
FIG. 1 is a schematic diagram showing an example embodiment of a thermal sealing packaging system of the present invention.

FIG. 1 is a schematic diagram generally showing the overall constitution of a thermal sealing packaging system according to one implementation. The implementation of FIG. 1 comprises a container transfer unit A that pulls out a film from a container film 1 wound in a roll shape and transfers it horizontally and linearly; a container molding unit B that mold-forms a container (cavity part) 2 on the transfer line of the container film 1 transferred by the container transfer unit A; a measurement unit C that measures the weight of a package item W located on the container molding unit B; a capping film supply unit D that supplies a capping film on a line separate from the container transfer unit A for covering the opening area of the container 2 transferred by a container transfer unit; a sealing unit E that causes the capping film 3 supplied by the capping film supply unit D to meet with the top surface of the container 2 transferred by the container transfer unit A and heat-seals them together; a cutting unit F provided on the downstream side of the sealing unit E; and an indication means G that indicates (prints) product information including the weight of the package item W, located on the supply route of the capping film 3 extending from the capping film supply unit D to the sealing unit E.

Figure 3:
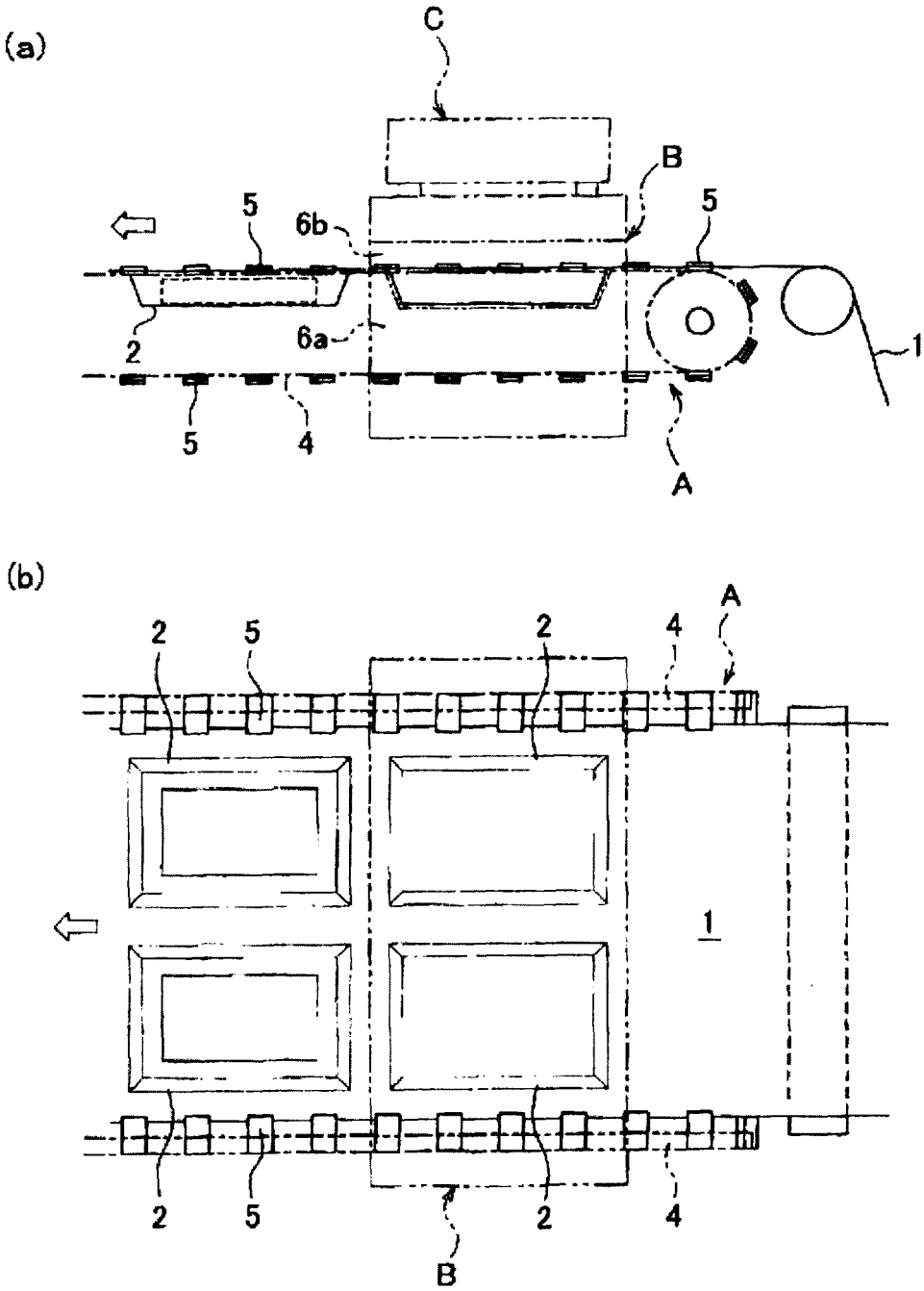
FIG. 3 shows an outline of a container transfer unit, wherein (a) is a front view of the container molding part and (b) is its plan view.

The container transfer unit A that pulls out the film from the container film 1 wound in a roll shape is equipped with grippers 5 placed with a certain interval on a pair of endlessly rotating front and rear chains 4 as shown in FIG. 3. As such, the container film 1 is gripped on both side of the width direction of the film 1 by the grippers 5 that are connected to the chains 4, and is fed as the chains 4 rotate. The chains 4 that constitute the container transfer unit A are driven intermittently in such a way that the container film 1 is fed one step (transfer amount) at a time. "One step" caused by the intermittent drive of the container transfer unit A means a transfer amount that forms containers (a pair of containers aligned in the direction of film width as shown in the drawing) with one molding operation of the container molding unit B.

In one implementation the container transfer unit A extends to a position where the packed container is cut off from the container film 1 in the cutting unit F. The grippers 5 keep closed to hold both edges of the width direction of the container film 1 during the forward track of the endlessly rotating chains 4 to feed the film 1, open to release the clamping of the container film 1 at the point of switching from the forward track to the return track, and close again to clamp the container film 1 at the point of switching from the return track to the forward track.

The container molding unit B is, as shown in FIG. 3, a molding unit of a well-known deep drawing type that forms a container (cavity part) 2 using heat and a mold from the container film 1, and is located to sandwich the film surface of the container film 1 horizontally transferred by the container transfer unit A. The container molding unit B comprises a mold 6*a* placed beneath the container film 1 and a heater plate 6*b* placed above the container film 1.

With the constitution described above, the container film 1 is blown upward with compressed air from below within the mold 6*a* and contacts with the heater plate 6*b* to be heated. The heated container film 1 is molded as it comes in contact with the inner surface of the mold 6*a* blown by the compressed air from the injection holes provided on the heater plate 6*b* for a specified period of time, to mold a container (cavity part) 2. After molding, the air inside the mold is changed, the mold 6*a* is lowered, and the molded container 2 is moved by the action of the container transfer unit A toward the forward direction of the transfer from the container molding unit B. Thus, with the intermittent drive of the container transfer unit A, the container 2 is formed with a certain interval along the lengthwise direction of the container film 1. The number of containers 2 to be formed by each cycle motion of the container molding unit B is not limited to be a pair aligned in parallel with the width direction of the film as shown in the drawing, but also can be one, or three (three columns), or multiple rows and multiple columns (e.g., 2×2=4).

Figure 2:
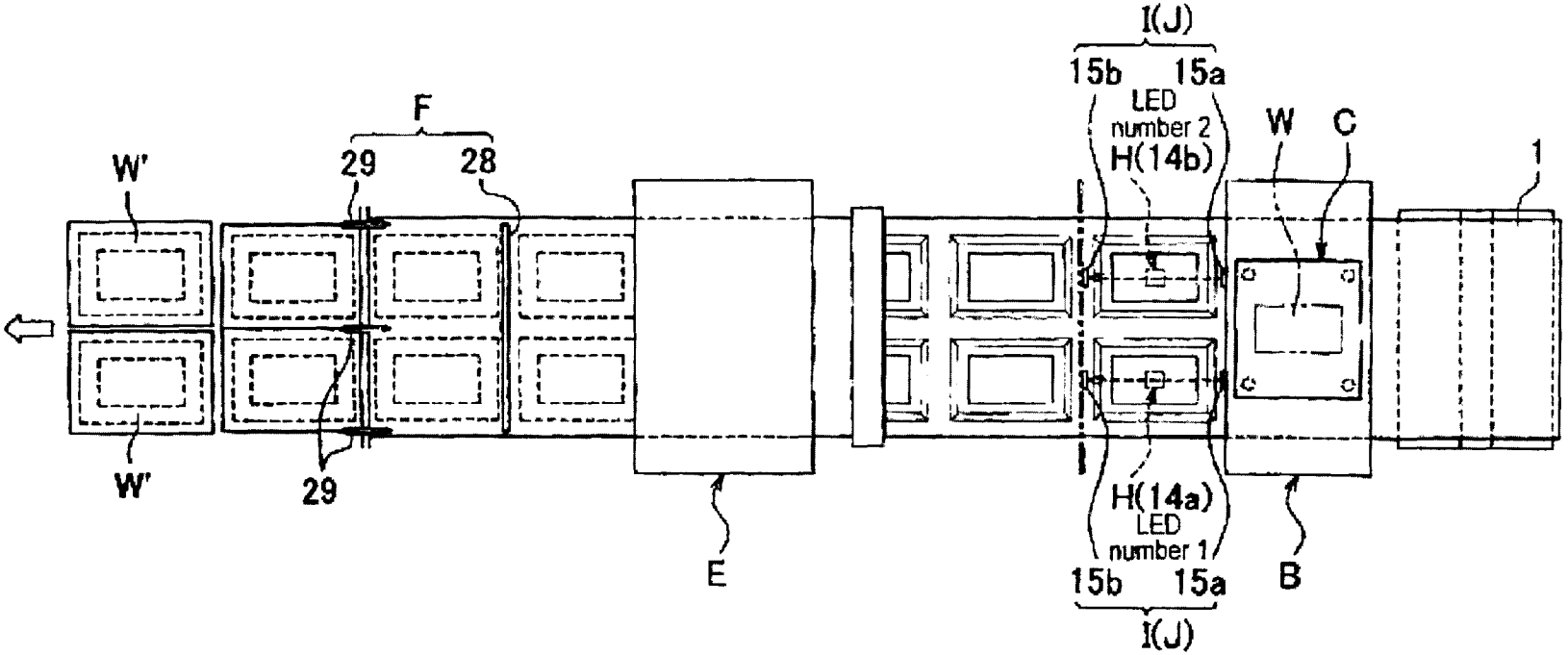
FIG. 2 is a plan view of the device of FIG. 1.

In one implementation a measurement unit C is provided on top of the container molding unit B for measuring the weight of the package item W, which is to be loaded into the container 2 formed in the container molding unit B. The measurement unit C may be a publicly known electronic scale, comprising a RAM 8, a ROM 9, a display unit 10, an operating unit 11, a measurement unit 12, and INF (interface) 13 connected via a bus 7*a* to a CPU 7, which controls various blocks, as shown in FIG. 7 (*a*). The INF 13 is communicable with an INF 24 and an INF 45. The CPU 7 controls various blocks using the work area of the RAM 8 in accordance with the control program of the ROM 9. The RAM 8 has a plurality of memory areas in which the file storing the measured weight (refer to FIG. 15 (*c*)), or data read from each file are temporarily stored. For example, some areas are available for the product file shown in FIG. 15 (*a*), additive file (not shown), etc. "Assignment 1" shown in FIG. 15 (*c*) represents the assignment of the first loading and "Assignment 2" represents the assignment of the second loading, each of them representing the location of a container to which the measured package item W is to be loaded. In other words, "Assignment 1" corresponds with the LED No. 1 and "Assignment 2" corresponds with the LED No. 2. In other words, as the LAM 8 remembers the weight in correspondence with the LED number, it is cable of identifying a weight as the weight of which package item contained in which container of which location. For example, if we assume that the container on the left side facing the direction of transfer in FIG. 2 is "Assignment 1 (LED No. 1)" and the container on the right side is "Assignment 2 (LED No. 2)," the weight of the package item to be loaded into the container of "Assignment 1" is stored on the column of "Assignment 1." In other words, the assignment of loading a package item in a container described here is an example where the order of assignment is determined in advance, e.g., there is an assignment for the container that corresponds to the LED number 1 and next the container that corresponds to the LED number 2. Also, "Prior 1" and "Prior 2" store the weights of the items measured one time prior to the items currently being measured in order to be applied to the containers assigned by the Assignment 1 and the Assignment 2 respectively. In other words, the data stored for "Assignment 1" is stored in "Prior 1" and the data stored for "Assignment 2" is stored in "Prior 2.

The display unit 10 may comprise a liquid crystal touch panel and the like, so that a part indicated on the screen can be selected by simply touching it with a finger. The operating unit 11 may be a keying input unit comprising a ten-key set, a clear key, a zero/reset key, etc. The measurement unit 12 may be a publicly known type comprising a measuring dish placed on top of a load cell, and issues a digital output signal by converting an analog signal output of the load cell.

A location one step downstream side of the container molding unit B, i.e., a location where the container 2 formed in the container molding unit B stops after having been transferred one step portion by the intermittent motion of the container transfer unit A, is where a package item supply unit K loads the package item W measured in the measurement unit C into the container 2. The location of the package item supply unit K is not limited to the one step downstream side of the container molding unit B as shown, but also can be set in the vicinity of the measurement unit C depending on its location. At the location of the package item supply unit K are also provided a container assignment unit H that assigns the container 2 to which the package item W is to be loaded, and a package item detection unit I that detects whether or not the package item W is loaded into the container 2.

The container assignment unit H is intended to assign a particular container 2 to which the measured package item W among the containers 2 that stop at the location of the package item supply unit K as shown in FIG. 1 and FIG. 2, wherein LED No. 1 (14*a*) and LED No. 2 (14*b*) are positioned beneath the containers 2 aiming at the bottoms of the containers 2. As such, the container 2 that is irradiated by lighting of the LED No. 1 (14*a*) or the LED No. 2 (14*b*) is thus assigned as the container to which the package item W is to be loaded.

The package item detection unit I is intended for detecting whether or not the package item W is loaded into the container 2 as shown in FIG. 1 and FIG. 2, and, in one implementation it is constituted in such a way that a pair of sensors 15*a* and 15*b* comprising a projector and a receiver are provided in front and rear parts of the opening of the container 2 that stops at the package item supply unit K. Whether or not the package item W is loaded is judged by detecting with the sensors 15*a* and 15*b* whether or not the light path from the projector to the receiver is interrupted by the worker's hand when loading the package item W into the container 2. The sensors 15*a* and 15*b* are provided for each row (two rows are shown in the drawing) of containers formed in the width direction of the container film 1. The package item detection unit I is capable of detecting which of the containers (right or left side facing the container transfer direction on the drawing) received the package item W, when the container assignment unit H is not provided, or its function is turned off even thought is provided.

The capping film supply unit D is intended to supply the capping film 3 for covering the opening are of the container 2 to which the package item is loaded as shown in FIG. 1, wherein the capping film 3 wound in a roll shape is guided via a guide roller 16 to the top surface of the opening area on the container 2 transferred by the container transfer unit A and thermal sealed on the top surface of the opening area of the container 2 in the sealing unit E. Thus, the capping film 3 is fed step by step intermittently with a certain interval with the transfer of the container 2 (container film 1) as the container 2 driven by the container transfer unit A and the capping film 3 are united by thermal sealing.

At a certain distance upstream from the sealing unit E on the supply route of the capping film 3 an indication means G is located, for printing (indicating) the product information including the measurement data (weight) of the package item W on the capping film 3. The indication means G may comprise a publicly known printer 17 that prints on the capping film 3 by means of applying heat on a ribbon ink using a thermal head, and a receiving plate 18 that keeps the capping film 3 in a flat condition is provided on the backside (plane opposite to the printing plane) of the capping film 3 that faces the printer 17 for the entire width direction of the capping film 3. The printer 17 comprises a RAM 20, a ROM 21, a printing unit 22, a moving unit 23 to cause the printing unit 22 to travel horizontally, and INF (interface) 24 connected via a bus 19*a* a to a CPU 19, which controls various blocks, as shown in FIG. 7 (*b*). The INF 24 is communicable with the INF 13. The RAM 20 has a plurality of memory areas for temporarily storing the measurement data (weight) of the package item W transmitted from the measurement unit C and the data read from each file.

Figure 5:
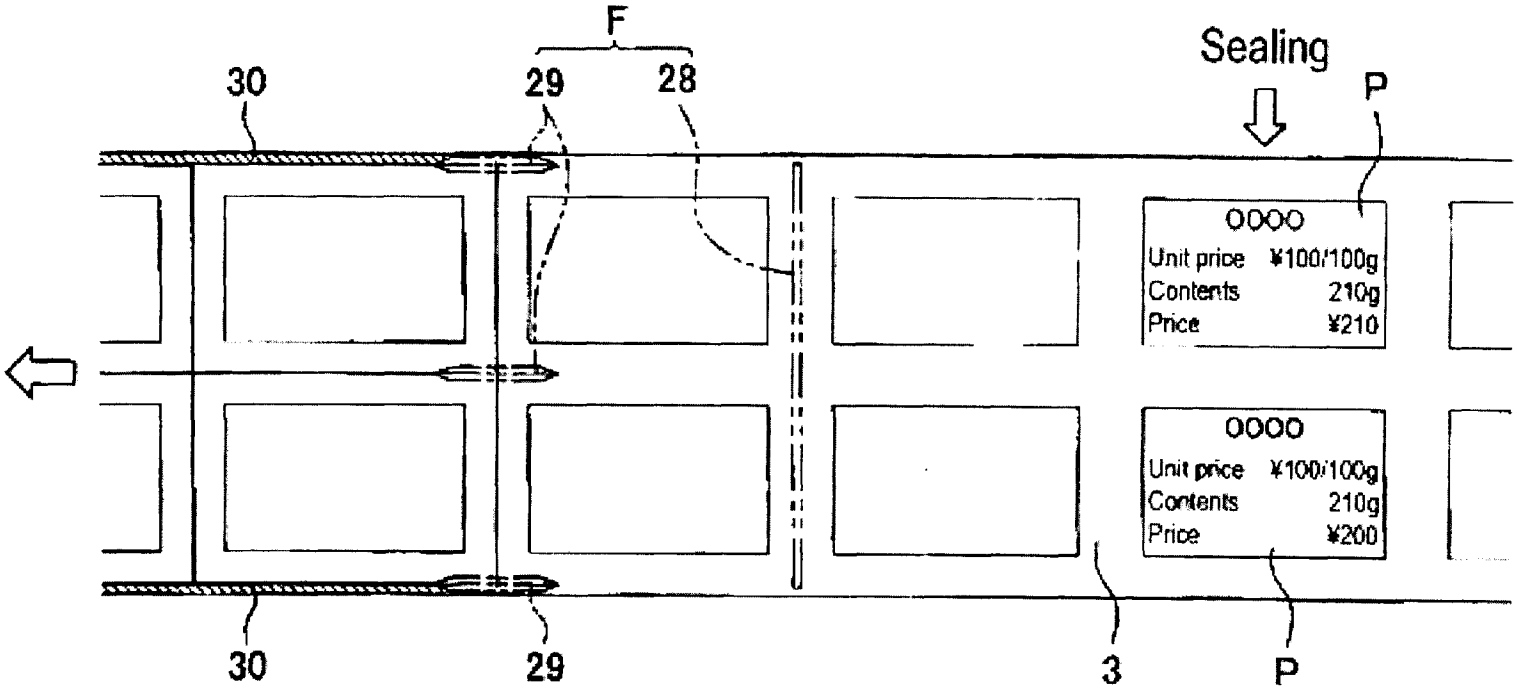
FIG. 5 is a plan view showing the constitution of a cutting unit located on the downstream side of a sealing unit of a thermal sealing packaging system.

In one implementation the printer 17 moves horizontally from one side to the other side (Assignment 1 side to Assignment 2 side in case of the drawing) of the width direction of the capping film 3 to print data for a portion of containers formed on the container film 3 (two rows in case of the drawing). The printer 17 executes printing as it comes in contact with the printing plane side of the capping film 3 after moving a certain distance, moving in the width direction of the film, being moved away from the film when printing is finished, and being returned to the initial position (the one side of the film). In one implementation the printed items P the printer 17 prints on the capping film 3, as shown in FIG. 5, include the measurement data (weight) and the information (product name, unit price, additives, etc.) specified to the product number (product file). The printing process of the printer 17 can be executed either when all the weights (measurement data) of the package items W to be loaded on the row of containers (one row of two pieces in case of the drawing) formed on the container film 1, printing two at a time, or printing for each container individually.

Figure 4:
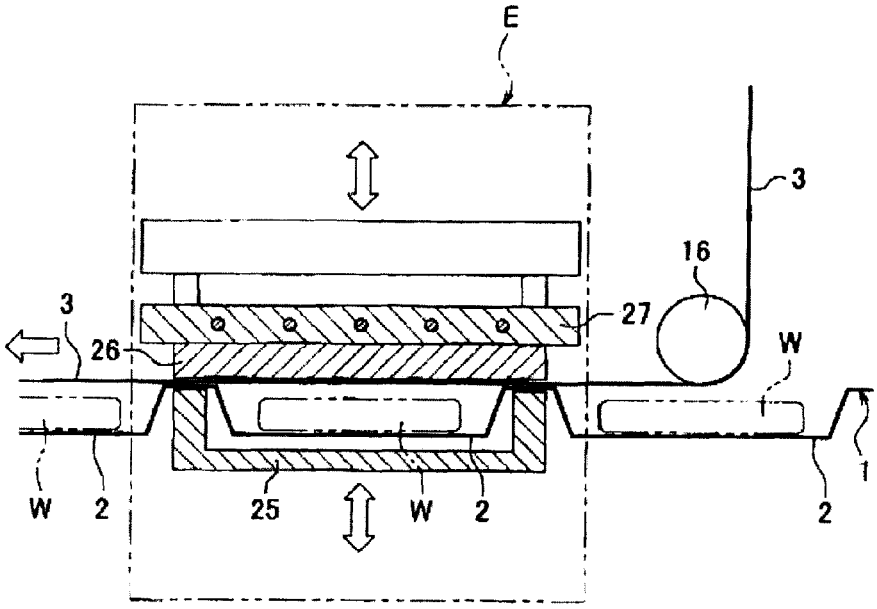
FIG. 4 is an enlarged cross-sectional view of a sealing unit.

The sealing unit E is intended for covering the opening area of the container 2 loaded with the package item W transferred by the container transfer unit A with the capping film 3 printed with the product information concerning the package item W loaded in the particular container, and heat-seal it to the container 2. FIG. 4 shows the constitution of the air-filled type sealing unit E. In the air-filled type packaging, the capping film 3 covers the opening of the container 2 loaded with the package item W and transferred to the sealing mold as is, and is thermally sealed. In a brief description, it comprises, as if to sandwich the container 2 transferred horizontally, a sealing mold 25 provided beneath the container 2 to be able to move up and down, a sealing plate 26 provided to close the top plane of the sealing mold 25 to be able to move up and down, and a heater plate 27 placed on top of the sealing plate 26 in lamination. After the capping film 3 thermally seals the periphery of the opening area of the container 2 while the sealing mold 25 and the sealing plate 26 are clamping the container 2 and the capping film 3, the sealing mold 25 and the sealing plate 26 move away from each other thus causing the mold to open; the container whose packaging process is completed now moves away from the sealing unit E as it is propelled by the container transfer unit A, and the next set of container 2 and capping film 3 comes into the sealing unit E.

The container, whose packaging process is completed with the container 2 and the capping film 3 having been thermal sealed together in the sealing unit E, is cut off from the container film 1 in the cutting unit F located on the downstream side of the transfer direction. The cutting unit F may comprise, as shown in FIG. 1 and FIG. 2, a transversal cutter 28 that cuts the container film 1 transversally to separate the containers from each other along the transfer direction (longitudinal direction) of the film with a certain interval, and a longitudinal cutter 29 that cuts the container film 1 longitudinally to separate the rows (two rows in case of the drawing) of containers formed in the width direction of the film 1 as well as to cut off the unnecessary portions (wastes) on both edges of the film 1 in the width direction. The transversal cutter 28 and the longitudinal cutter 29 are placed with a certain distance between them, e.g., one step apart between them, along the transfer direction of the container transfer unit A.

The transversal cutter 28 is intended to cut the area where the container film 1 and the capping film 3 are thermally sealed and comprises two cutting blades 28*a* and 28*b* placed to pinch the two films from top and bottom, wherein the bottom blade 28*b* moves up and down actuated by a cylinder and the like (not shown) relative to the stationary top blade 28*a*. The longitudinal cutter 29 comprises a plurality of rotary cutters (three cutters in case of the drawing), one in the middle and two on both sides of the film width direction, to separate the two containers formed in parallel in the film width direction and to cut off the unnecessary portions (wastes) on both edges of the film width direction, thus completing packaged merchandise. The unnecessary portions (wastes) 30 on both edges of the film width direction thus cut off are taken up on a film waste take-up shaft 31 to be separated from the packaging device, while the packaged merchandise W' is discharged from the packaging device by means of a discharge conveyor 32.

Figure 6:
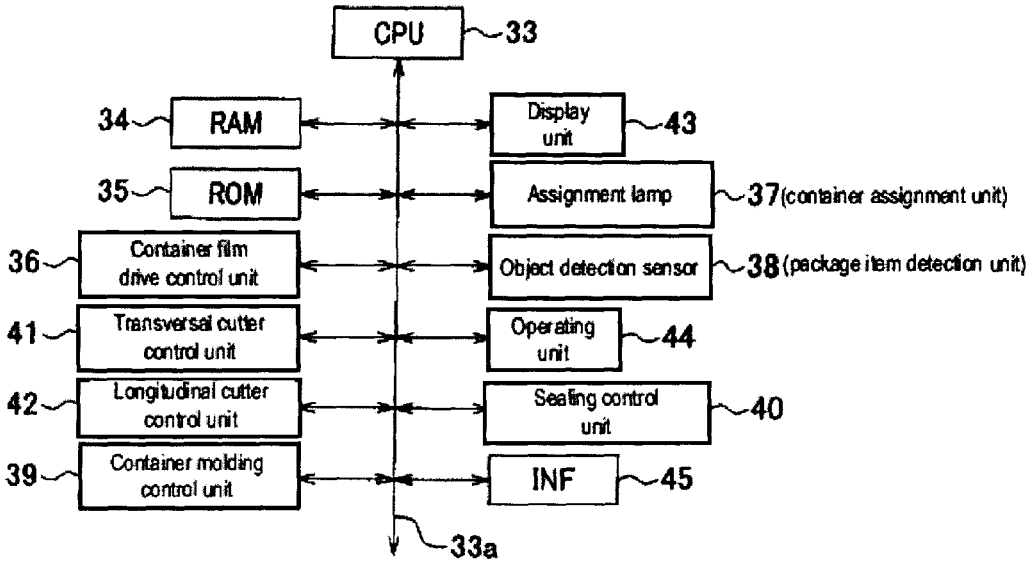
FIG. 6 is an electrical block diagram of a packaging system.

The thermal sealing packaging system described above may comprise, as shown in FIG. 6, a RAM 34, a ROM 35, a container film drive control unit 36, assignment lamps 37, object detection sensors 38, a container molding control unit 39, a sealing control unit 40, a transversal cutter control unit 41, a longitudinal cutter control unit 42, a display unit 43, an operating unit 44, and an INF (interface) 45 all connected via a bus 33*a* to a CPU 33 that controls various units described in the above. The INF 45 is communicable with the INF 13. In one implementation the RAM 34 has a plurality of memory areas to store, for example, as shown in FIG. 15 (*b*), the status of the container assignment unit H (assignment lamp status, e.g., "0" on LED No. 1 and 2 means the lamp is "OFF"; "1" means "ON") and the status of the package item detection unit I (loading status, e.g., "0" on the object detection signal means "not loaded"; "1" means "loaded"). The container film drive control unit 36 controls the drive of the container transfer unit A to transfer the container film 1 intermittently one step at a time. The assignment lamp 37 controls the lamps (LED) 14 of the container assignment unit H. The object detection sensor 38 controls the package item detection unit I. The container molding control unit 39 controls the functions of the container molding unit B, i.e., opening/closing of the mold, injection/stop of compressed air, energization of the heater plate, etc. The sealing control unit 40 controls the functions of the sealing unit E, i.e., the up/down motion (opening/closing), energization of heater plate, etc. The transversal cutter control unit 41 controls the timing of motions (up/down) of the transversal cutter 28. The longitudinal cutter control unit 42 controls the timing of motions (rotation) of the longitudinal cutter 29. The display unit 42 comprises a liquid crystal touch panel and the like, so that a part indicated on the screen can be selected by simply touching it with a finger. The operating unit 43 is a keying input unit comprising a ten-key set, a clear key, a zero/reset key, etc. The display unit 42 and operating unit 43 are provided on a console (not shown). The INF (interface) 45 handles signal exchanges as it is connected to the measurement unit (scale) C and the printer 17 of the indication means G.

Figure 8:
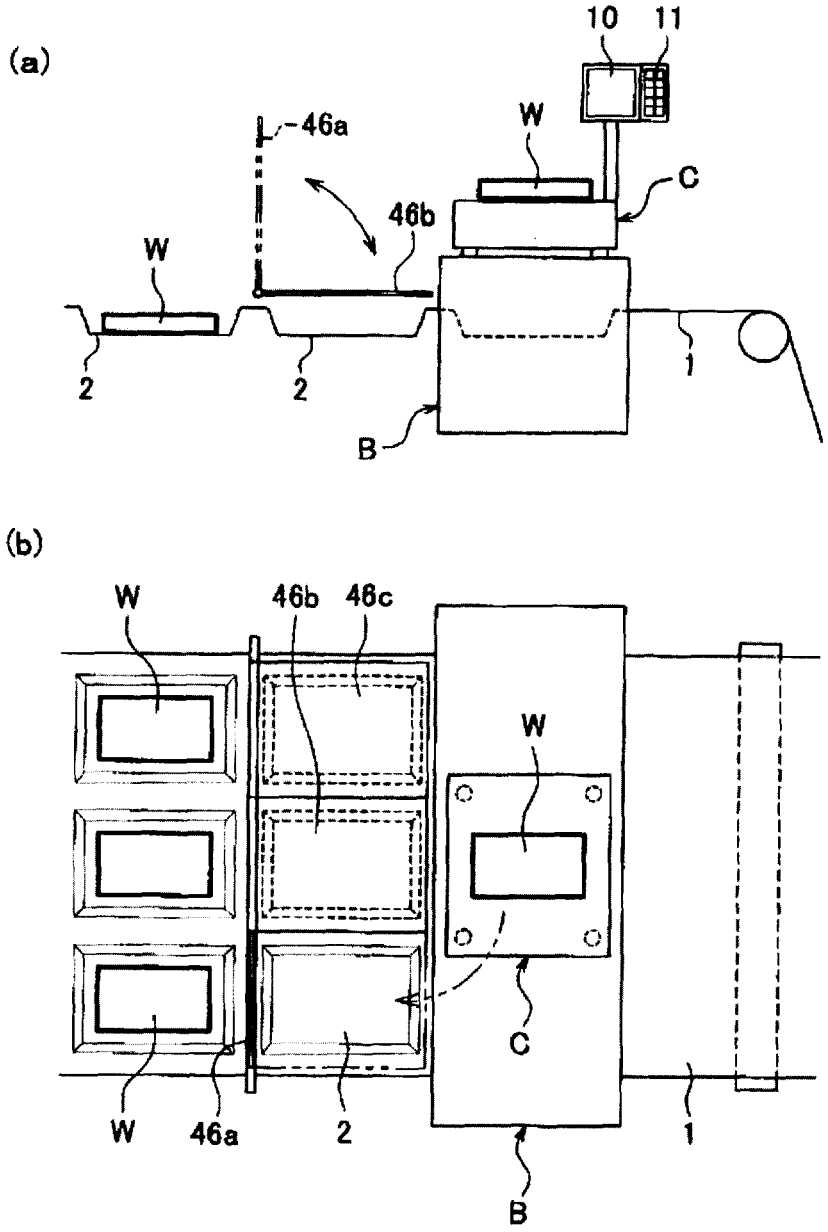
FIG. 8 is another example of a container assignment unit (top to bottom rotating type), wherein (a) is a front view and (b) is its plan view.
Figure 9:
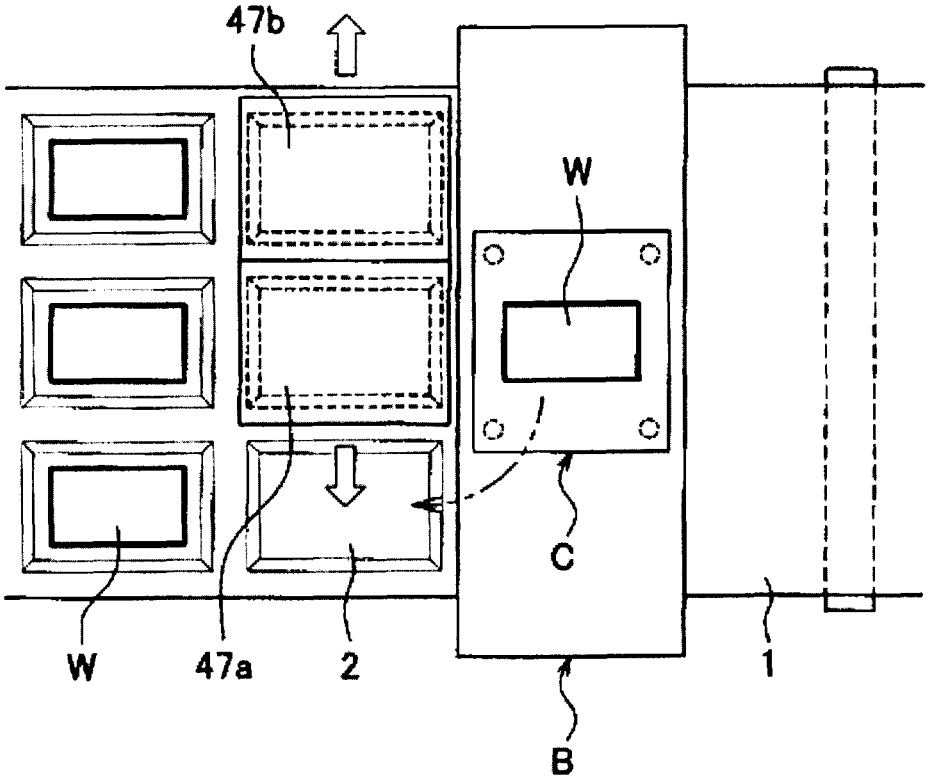
FIG. 9 is a plan view showing another example of a container assignment unit (horizontally sliding type).

FIG. 8 and FIG. 9 show different embodiments of the container assignment unit H. FIG. 8 shows an arrangement wherein shutters 46*a*, 46*b*, and 46*c* that close their respective openings, are arranged above the openings of a row of three containers formed parallel in a row on the container film 1 to enclose them, so that a particular container can be assigned by the opening of the shutters. The opening/closing of the shutter is activated by a motor, air cylinder and the like, and the closing motion is controlled by the detection signal (loading detection) of the package item detection unit I. The drawing shows the shutter 46*a* opened, so that the measured package item W is assigned to be loaded into the near side (leftmost facing the transfer direction) container 2.

FIG. 9 shows a container assignment unit equipped with a horizontally sliding type shutter, wherein, similar to the above-mentioned embodiment, two shutters 47*a* and 47*b* are arranged to be able to move horizontally above a row of three containers formed parallel in a row on the container film 1 to enclose the openings of the containers other than the one to which the package item is to be loaded with the horizontal slides of the shutters 47*a* and 47*b* so that the container with a free opening not covered by the shutter can be assigned. In the drawing, the measured package item W is assigned to be loaded into the near side (leftmost facing the transfer direction) container 2 as it has no shutter over it making it open. In the same drawing, in order to assign the center container to be loaded, the shutter 47*a* is moved over the near side container; on the other hand, in order to assign the farthest (rightmost facing the transfer direction) container, the shutters 47*a* and 47*b* are moved to the left side.

Figure 10:
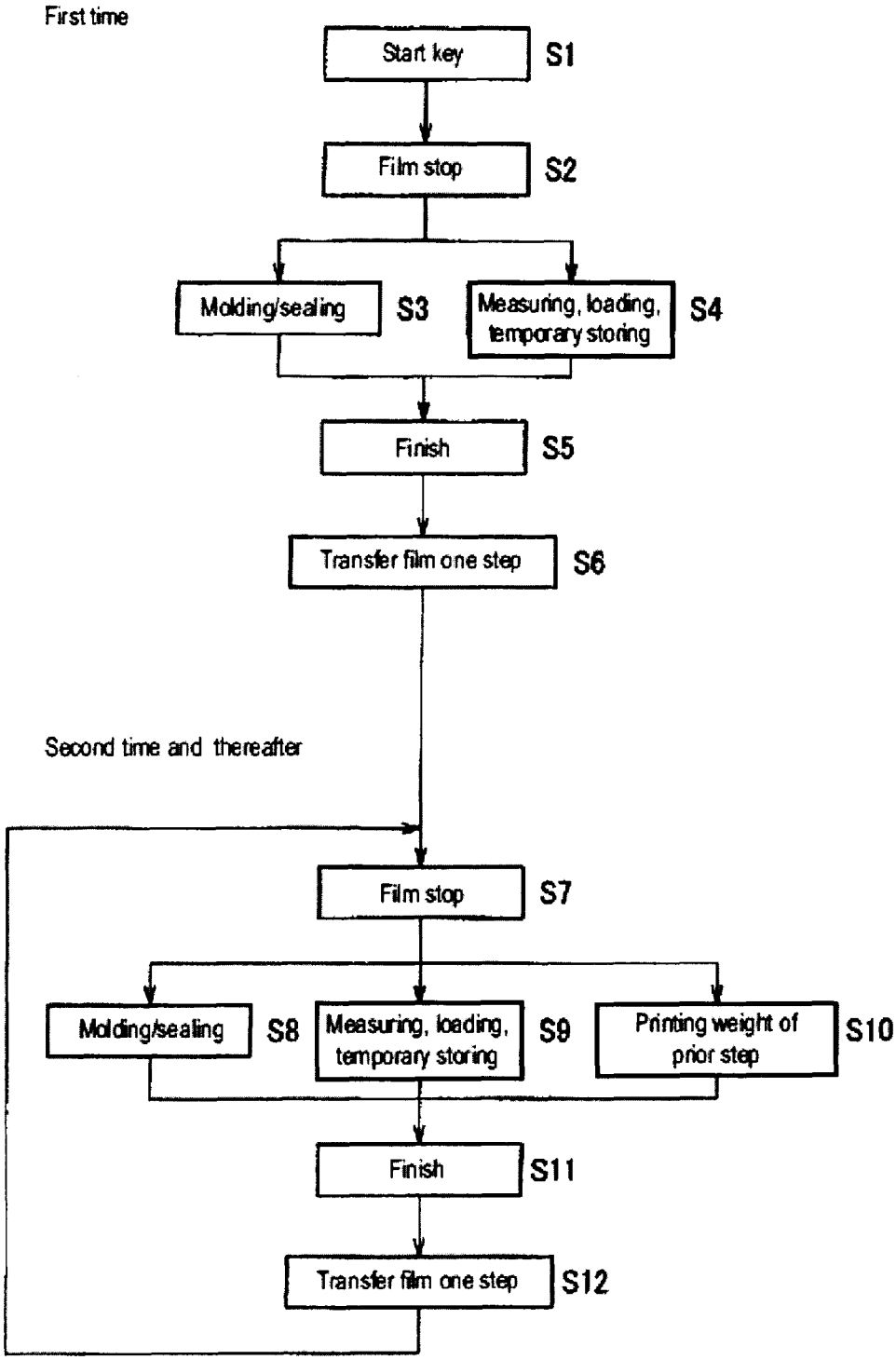
FIG. 10 is an explanatory diagram showing a timing of each movement from measurement of the package item to thermal seal packaging.

Next, an overall flow of the above-mentioned thermal sealing packaging system will be described below based on the flowchart of FIG. 10. The flow will be described breaking down into the first step movement of the first time and the first step movement of the second time and thereafter, based on the one step intermittent drive of the container transfer unit A shown in the schematic diagram of FIG. 1. The container film 1 starts from the point when the molded container 2 is located at the package item supply unit K as shown in FIG. 1. The description will be made assuming that the indication means G (printer 17) that prints on the capping film 3 is located three steps upstream side from the position of the sealing unit E, and the package item supply unit K is located four steps upstream side from the position of the sealing unit E, as shown in FIG. 1.

First cycle:

S1: Press down the start key (it is located on the operating unit mounted on the console of the packaging device).

S2: In this state, both the container film 1 and the capping film 3 are stationary (container transfer unit A is stationary).

S3: When a specified time has passed from S2, a container 2 is molded on the container film 1, in the container molding unit B, and the container film 1 that is transferred simultaneously to the sealing unit E and the capping film 3 are heat-sealed together.

Figure 14:
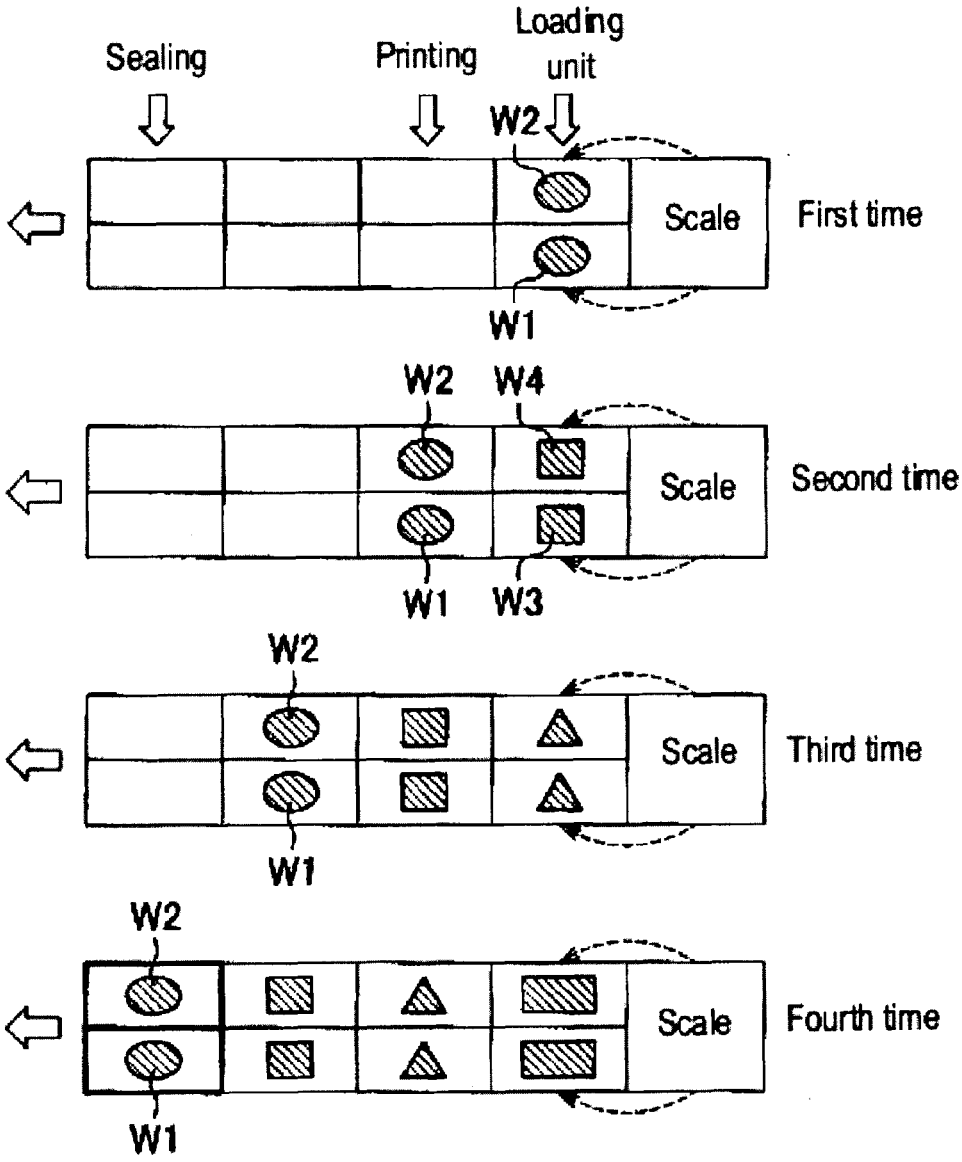
FIG. 14 is a flowchart showing a flow of a control unit of an indication means in one implementation.

S4: As the package item W1 (elliptical shape of FIG. 14) is placed on the measurement unit C simultaneously with S3, the measurement data outputted from the measurement unit C is stored in a temporary storage area 1 (not shown) which holds no data currently among the temporary areas 1 and 2 of the RAM 8, and the measured package item W1 is loaded into the container 2. Next, the package item W2 (elliptical shape of FIG. 14) is placed on the measurement unit C, the measurement data outputted from the measurement unit C is stored in a temporary storage area 1 (not shown) which holds no data currently among the two temporary areas 1 and 2 of the RAM 8, and the measured package item W2 is loaded into the container 2.

S5: When container molding and sealing in S2 as well as measurement and loading in S3 are all finished, the cycle is complete. Container molding and sealing processes are judged to be completed after a certain period of time, while measurement and loading processes are judged to be completed when measurement data is stored temporarily in the temporary storage area 1 or 2 of the RAM 8 and loading is detected by the object detection sensor 38. The measurement data stored in the temporary storage area 1 or 2 is then transferred to and stored in the printing buffer (not shown) provided in the RAM 8 for printing, and the temporary storage areas 1 and 2 are cleared.

S6: The container transfer unit A is driven to transfer the container film 1 by one step. Since the capping film 3 is already thermal sealed with the container film 1 in the sealing unit E, it is transferred together with the container film 1 by one step.

Second time and thereafter:

S7: Both the container film 1 and the capping film 3 are stationary (container transfer unit A is stationary).

S8: When a specified time is passed from S7, a container 2 is formed on the container film 1 in the container molding unit B and the container film 1 that is transferred simultaneously to the sealing unit E and the capping film are thermally sealed together.

S9: As the package item W3 (square shape of FIG. 14) is placed on the measurement unit C simultaneously with S8, the measurement data outputted from the measurement unit C is stored in a temporary storage area 1 which holds no data currently among the two temporary areas 1 and 2 (not shown) of the RAM 8, and the measured package item W3 is loaded into the container 2. Next, the package item W4 (square shape of FIG. 14) is placed on the measurement unit C, the measurement data outputted from the measurement unit is stored in a temporary storage area 2 of the RAM 8 which holds no data currently, and the measured package item W4 is loaded into the container 2.

S10: During the same period of time as S8 and S9, i.e., when both the container film 1 and the capping film 3 are stationary, the measurement data of the package item W1 and the package item W2 temporarily stored in the printing buffer in S5 in the previous cycle are printed on the capping film 3. When printing is completed, the measurement data temporarily stored in the printing buffer is cleared, the data stored in the temporary storage areas 1 and 2 in S9 are stored in the printing buffers respectively, and the data stored in the temporary storage areas 1 and 2 are cleared.

S11: When container molding and sealing processes in S8, measurement and loading process in S9, and printing in S10 are finished, the cycle is complete.

S12: The container transfer unit A is driven to transfer the container film 1 by one step.

In the total flow described above and as shown in FIG. 14 and FIG. 1, the package item W (elliptical) measured in the measurement unit C is loaded into the container 2 molded in the previous step, and the measurement data (the measurement data of the package item (elliptical)) is printed on the capping film 3 when the container 2 containing the particular package item W (elliptical) moves one step. The container 2 containing the package item W (elliptical) and the capping film 3 printed with the measurement data of the particular package item move together toward the sealing unit E for the same steps (two steps), united in the sealing unit E to be sealed. Thus, the product information including the measurement data indicated on the container (capping film) matches with the package item contained in the container without fail.

Since several independent control units may be used in the present invention, the control unit of the measurement unit C, the control unit of the packaging machine (controlling the transfers of the container film and the capping film, molding and sealing processes, etc.), and the control unit of the printer will be described below separately.

Figure 11:
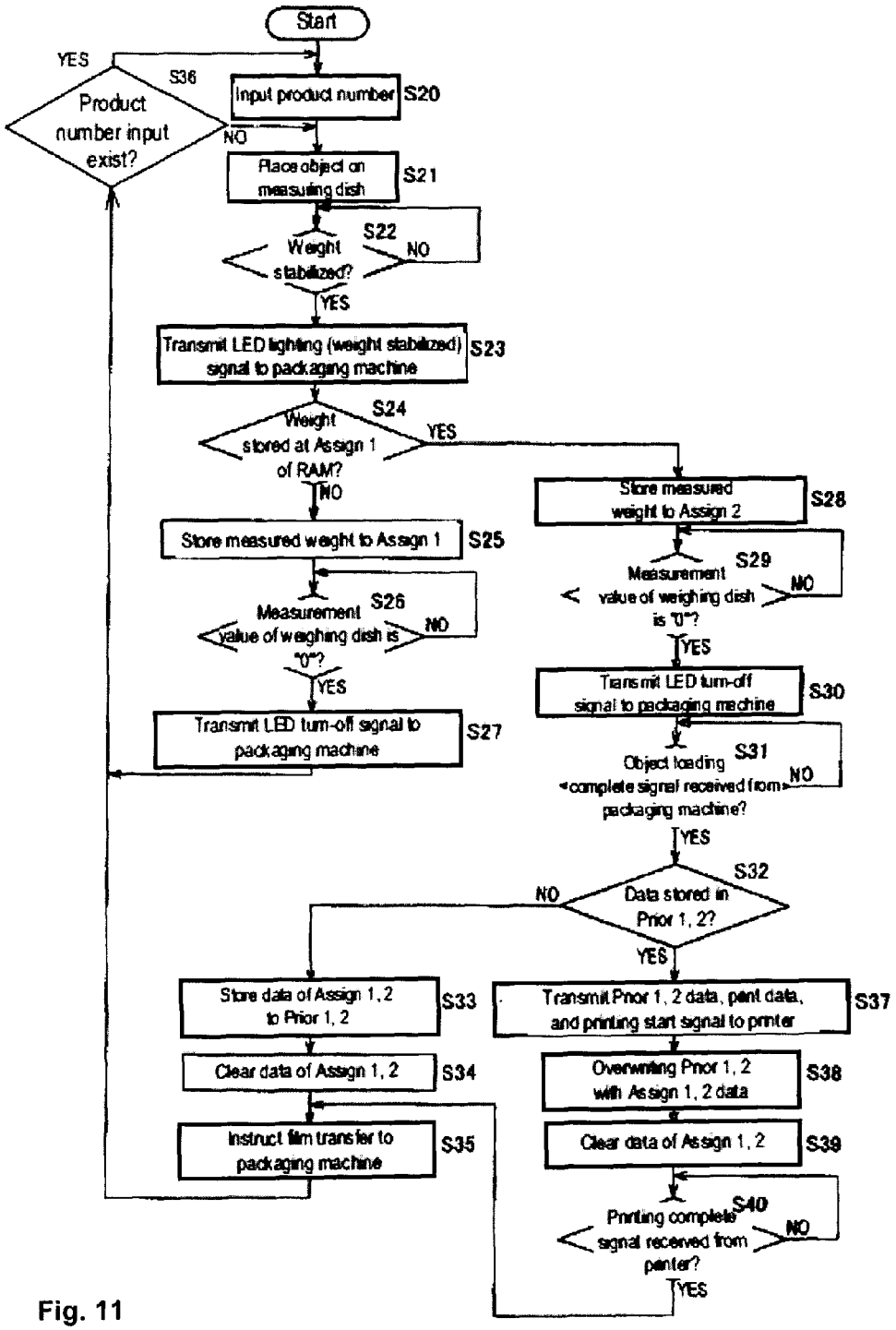
FIG. 11 is a flowchart showing a flow of a packaging system in one implementation.

First, a flow of the control unit (CPU) of the measurement unit C will be described below based on FIG. 11. In the following description, it is assumed that two containers are molded in parallel on the container film 1 in one step, and the order of lighting of the LEDs in the container assignment unit H is to light the left side facing the transfer direction of the container (LED No. 1) followed by the right side (LED No. 2).

S20: Enter the product number of the package item W from the operating unit 11 and read the data related to the product number from the product file.

S21: Place the package item Won the weighing dish of the measurement unit C.

S22: A judgment is made as to whether the weight of the package item W placed in S21 is stabilized or not. If it is stabilized (Yes), the program advances to S23; if it is not stabilized (No), the same judgment is repeated.

S23: As the weight is stabilized, a request signal for lighting the LED (container assignment unit H) is transmitted to the packaging machine.

S24: A judgment is made as to whether or not the measurement data (weight) is stored in Assignment 1 (LED No. 1) of the RAM 8. If it is stored (Yes), the program advances to S28; if it is not stored (No), it advances to S25.

S25: The measurement data (weight) is stored in the cell of Assignment 1 (LED No. 1) of the RAM 8 (refer to FIG. 15(*c*)).

S26: A judgment is made as to whether or not the measurement data of the measurement unit C is "0." In other words, a judgment is made as to whether or not the package item W placed on the weighing dish in S21 is removed completely in order to be loaded into the container 2 lighted by the LED 1 (container assignment unit H). If it is "0" (Yes), the program advances to S27; if it is not "0" (No), it continues checking until it turns to "0."

S27: As it is confirmed that the package item W placed on the weighing dish is loaded into the container 2, a LED turn off signal is transmitted to the packaging machine.

S28: The measurement data (weight) is stored in the cell of Assignment 2 (LED No. 2) of the RAM 8 (refer to FIG. 15(*c*)).

S29: A judgment is made as to whether or not the measurement data of the measurement unit C is "0." In other words, a judgment is made as to whether or not the package item W placed on the weighing dish in S21 is removed completely in order to be loaded into the container 2 lighted by the LED 2 (container assignment unit H). If it is "0" (Yes), the program advances to S30; if it is not "0" (No), it continues checking until it turns to "0."

S30: As it is confirmed that the package item W placed on the weighing dish is loaded into the container 2, a LED turn off signal is transmitted to the packaging machine.

S31: A judgment is made as to whether or not the package item W loading completion signal is received from the packaging machine. If the signal is received (Yes), the program advances to S32; if it is not received (No), the judgment is repeated.

S32: A judgment is made as to whether or not the measurement data (weight) are stored in the cells of Prior 1 and 2 of the RAM 8 (FIG. 15(*c*)). If it is stored (Yes), the program advances to S36; if it is not stored (No), it advances to S33.

S33: Store the measurement data (weight) stored in the cells of Assignments 1 and 2 of the RAM 8 into the cells of Prior 1 and 2.

S34: Clear the measurement data (weight) stored in the cells of Assignments 1 and 2 of the RAM 8.

S35: An actuating instruction for the container transfer unit A for transferring the container film 1 is transmitted to the packaging machine.

S36: A judgment is made as to whether there is any input for a new product number (package item different from the previous package items). If there is an input of a new product number (Yes), the program advances to S20; if it is to continue to pack the same package item (No), it advances to S21.

S37: Relate the weight data stored in the cells of Prior 1 and 2 (LED No. 1 and 2) of the RAM 8 to each LED number, and transmit the product data to be printed such as the product names and unit prices read in S20 and the print start command to the printer 17 (indication means G).

S38: Prior 1 and 2 are overwritten with the weight data stored in Assignments 1 and 2, while the weight data stored Prior 1 and 2 are stored into the weight history cells.

S39: The data of Assignments 1 and 2 stored in the RAM 8 are cleared.

S40: A judgment is made as to whether or not a printing completion signal is received from the printer 17 (indication means G). If it is received (Yes), the program advances to S35; if it is not received (No), the same judgment is repeated.

Figure 12:
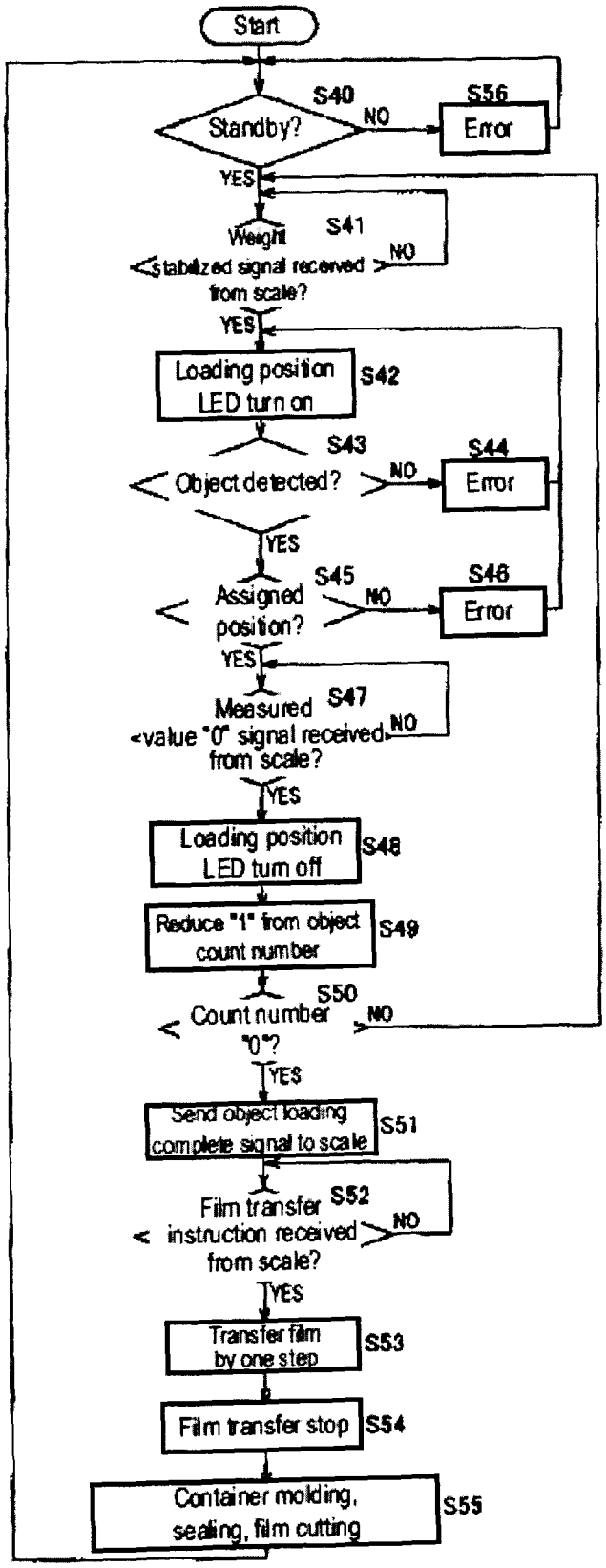
FIG. 12 is a flowchart showing a flow of a control unit of a packaging system in one implementation.

Next, a flow of the control unit (CPU) of the packaging machine (transfers of the container film and the capping film, container molding, sealing, etc.) will be described based on FIG. 12.

S40: A judgment is made as to whether or not sensors are in the standby status. If they are in the standby status (Yes), the program advances to S41; if they are not in the standby status (No), an error signal is displayed on the display unit 43 of the packaging machine.

S41: A judgment is made as to whether or not a weight stabilization signal is received from the measurement unit C. If it is received (Yes), the program advances to S42; if it is not received (No), the same judgment is repeated.

S42: Turns on LED 14 (container assignment unit H) which is the LED No. 1 for assigning a container to which the package item W is to be loaded. In this case, as "1" is stored if lighting is instructed and "0" is stored if lighting is not instructed for the areas of LED numbers 1 and 2 in the RAM 34, the lighting instruction is sent to the LED number which is not "1" among the LED numbers 1 and 2. If in case both LED numbers 1 and 2 are "0," the data "1" is sent to the LED number 1 to turn on the light (refer to FIG. 15 (*b*)).

S43: A judgment is made as to whether or not the package item detection unit I has detected that a package item W is loaded into the container lit by the LED 14, which is the LED number 1. If the loading is detected (Yes), the program advances to S45; if it is not detected (No), the program advances to S44. The package item detection unit I is provided one each in correspondence with the LED number 1 and the LED number 2 (row of containers). When the loading is detected by the package item detection unit I, the data "1" is stored in the corresponding cell of the RAM 34. If it is not detected, the data "0" is stored (refer to FIG. 15 (*b*)).

S44: If no loading is detected by the package item detection unit I (sensors 15*a*, 15*b*) within a specified time after the LED number 1 or the LED number 2 is lighted in S42, it is displayed as an error on the display unit 43 of the packaging machine.

S45: A judgment is made as to whether or not the data "1" is stored as the object detection signal of the RAM 34 corresponding position assigned in S42. If "1" is stored (Yes), the program advances to S47; if "1" is not stored (No), the program advances to S46.

S46: Since loading of a package item is detected at a position (container) different from the position (container) assigned in S42, it is displayed as an error on the display unit 43 of the packaging machine.

S47: A judgment is made as to whether or not a signal indicating the measurement value "0" is received from the measurement unit C indicating that the entire package item placed on the weighing dish of the measurement unit C is loaded in the assigned container. If it is received (Yes), the program advances to S48; if it is not received (No), the same judgment is repeated.

S48: When it is confirmed that the entire amount of measured package item W is loaded at the position (container) lighted by LED in S42, the LED lighted in S42 is turned off.

S49: The object count number stored in the RAM 34 is counted down by "1." This count number represents the number of containers molded in he width direction of the container film, which is "two" in case of the present embodiment (refer to FIG. 2) as two containers are molded in the width direction of the film, but it would be "3" if three containers were molded in the width direction of the film.

S50: A judgment is made as to whether the count number is "0" or not. If the count number is "0," the program advances to S51; if it is not "0," the program returns to S41 and waits for the next package item weight stabilization signal.

S51: When two package items are loaded into the two containers of a row correctly, the package item loading completion signal is transmitted to the measurement means C.

S52: A judgment is made as to whether or not a film transfer instruction signal is received from the measurement unit C for transferring the container film. If the transfer instruction signal is received (Yes), the program advances to S53; if no transfer signal is received (No), the same judgment is repeated.

S53: The container film 1 is transferred by one step driven by the container transfer unit A. In this case, one step means the transfer of one row.

S54: The transfer of the container film 1 is stopped.

S55: Molding of the containers (container molding unit B), thermal sealing (seal unit E) between the containers 2 and the capping film 3, and cutting off of waste portions and the containers (cutting unit F) are simultaneously executed.

Figure 13:
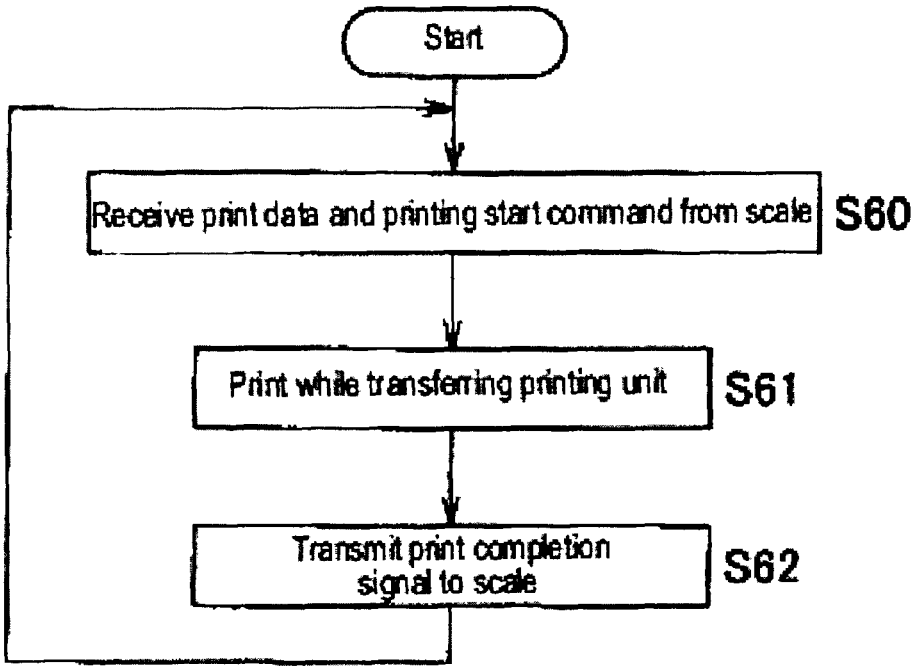
FIG. 13 is a flowchart showing a flow of a control unit of a measurement unit in one implementation.

Next, a flow of the control unit (CPU) of the printer 17 (indication means G) is described based on FIG. 13.

S60: Printing data (product name, unit price, etc.) transmitted from the measurement unit C, weight corresponding to LED number, and printing start command are received.

S61: Multiple the weight corresponding to LED number received in S60 with the unit price to calculate the price for each LED number, and print those items on the capping film 3 while moving the printing unit in the film width direction.

S62: Transmits the print completion signal to the measurement unit C.

In the embodiment described above, the number of containers molded on the container film 1 in a single transversal row is two, wherein Assignment 1 corresponds to LED number 1 and Assignment 2 corresponds to LED number 2 in the container assignment unit H, and the printer 17 of the indication means G prints in accordance with the preset format. Since the printer 17 has a printing format established in such a way that the weight of which LED number is to be printed and at which position of the capping film, it prints the weight corresponding with the LED number received from the measurement unit C accordingly.

Figure 16:
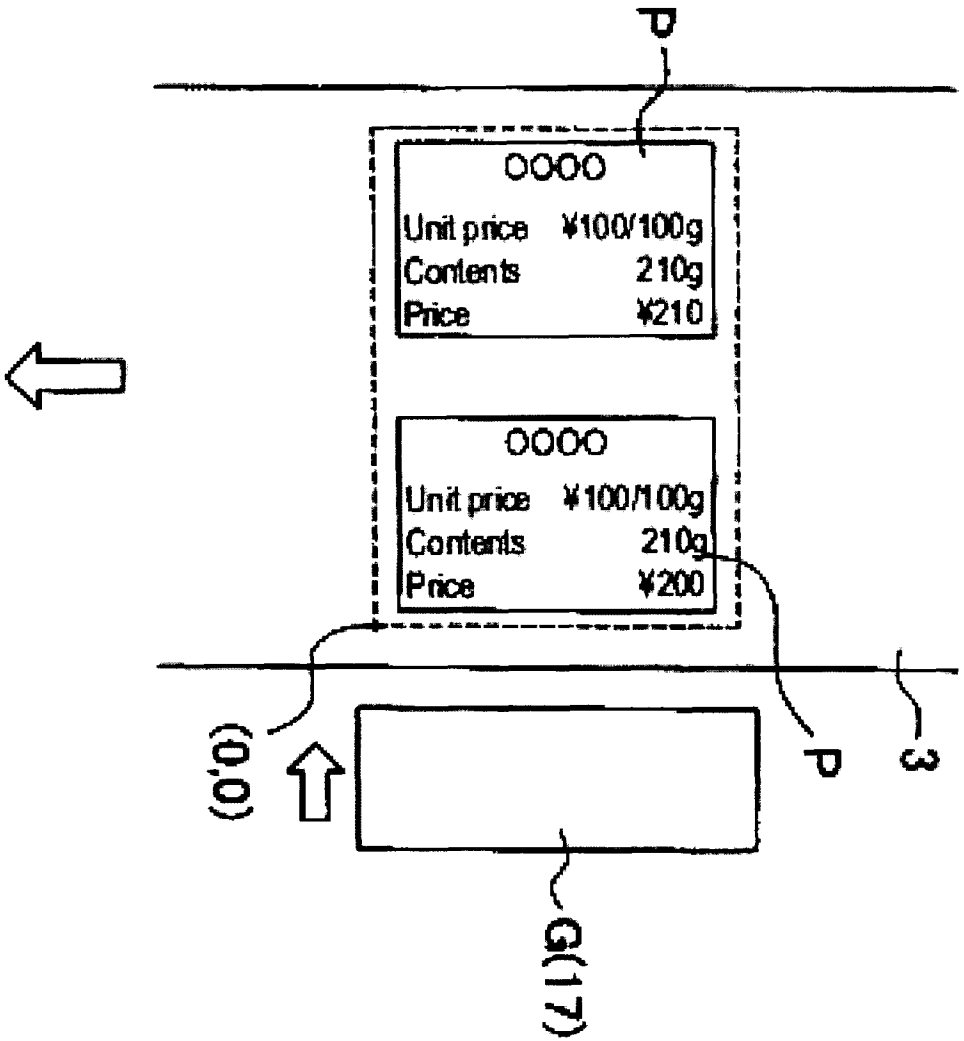
FIG. 16 is an explanatory diagram showing a condition of printing on the capping film using an indication means.

FIG. 16 shows an example where the weights corresponding to the LED number 1 and LED number 2 are printed on the capping film 3 by the indication means G (printer 17) of FIG. 1, overlaid with an image of the printing area enclosed by dotted lines. Since the printing format used in the particular printing devices is a publicly known type, its detail is not described here except to mention that the printing position of each printed character is defined according to a coordinate system consisting of X-axis and Y-axis with the right bottom corner of the printing area surrounded by dotted lines in FIG. 16 having the coordinate value of (0, 0). The coordinate position of each item being printed is predetermined by respective coordinate value, so that the weight related to the LED number 1, "200 g," and the weight related to the LED number 2, "210 g," for example, are printed in the specified positions respectively in case of FIG. 16. Also, the printing positions of the prices or unit prices of the LED number 1 and 2 as well as the product name shown here as "○○○○" in the drawing are all predetermined by their coordinate values, and their character sizes are predetermined as well. The position and the size of each printing item is well defined as each printing item has a rectangular frame, the coordinate position of a certain point on the rectangular frame is preset as described above, and the frame size is defined by the horizontal and vertical lengths of the frame. With the assigned container and the printing position information for the container thus being stored in combination, the weight value indicated (printed) on the cap of the container and the package item loaded in the cup match without fail so long as the measured package item is loaded into the assigned container. However, it can also be constituted to have three containers molded on the container film 1 in a row transversally, and the loading assignment according to the container assignment unit H can be done in a random order, not in a predetermined order. In such a case, in order to light LEDs to denote loading positions in S42 of FIG. 12, it can be constituted in such a way that the number for identifying each LED (LED number) is transmitted to the measurement unit C, and the LED number and the weight are stored in combination with each other in S25 or S28. Moreover, since the LED number indicates the position of the container, printing can be executed without fail by printing in the order of LED as the weight is stored in combination with the LED number, even if the container loading is done in the order of LED number 1→LED number 2. In other words, while Assignment 1 is LED number 1 and Assignment 2 is LED number 2 in the previous case, the LED number to identify the loading position received from the CPU of the packaging machine is correlated to the stabilized weight after the measurement is stabilized in case of a random assignment. It can also be constituted in such a way that the weight and the LED number are transmitted in combination from the measurement unit C to the printer, and that the weigh value is printed on the position matching the LED number.

The number of containers molded on the container film 1 in one step transfer can be, in addition to two shown in the embodiment of the drawing, three in a row, or multiple rows and multiple columns (e.g., 2×2=4). In this case, in addition to the method of instructing LED lighting (container assignment unit H) in a predetermined order as in the case of the embodiment, it can also be constituted in such a way as to control the loading container (position) and weight in combination without having the container assignment unit H. In such a case, the package item detection unit I is used for detecting the loading of the package item into the container. One method is to output the weight and store it in a temporary storage area (not shown) of the RAM 8 when the package item W is placed on the measurement unit C and the measurement value becomes stable. When loading of the package item is detected by the object detection sensor 38 (the package item detection unit I (sensors 15*a*, 15*b*)) within a certain period of time, the control unit (CPU 33) of the packaging machine transmits the sensor number (15*a*, 15*b*) of the sensor which detected it to the measurement unit C via the INF 45, and the measurement unit C stores the received sensor number in combination with the outputted weight. When loading of the package items into all the containers of a single row, the sensor numbers are transmitted in combination with the weight values to the printer 17 (indication means G). As the object detection sensors 38 are arranged in the order of numbers, the printer 17 (indication means G) prints the weight values in the order of sensor numbers. Thus, the package item loaded into the container is guaranteed to match with the product information including the weight printed on the capping film of the particular container.

The methods of thermal seal packaging, as described in reference to the thermal sealing packaging system shown in the drawings, involves methods where the container to contain the package item and the capping film for covering the opening of the container are transferred separately, the opening of the container being covered by the capping film after the item is loaded into the container, and the periphery of the capping film is thermal sealed. The methods comprise a measuring process for measuring the weight of the item prior to the loading of the item into the container and a indicating process of indicating the measurement data (weight) obtained in the measuring process on the capping film to be supplied to the packaging stage, wherein the capping film indicated with the measurement data (weight) is controlled to cover the opening of the particular container containing the corresponding item. The container for the package item is not limited to be provided by the method of molding it from a film (container film) during the transfer of the film and transferring as shown in the drawing, but also can be provided by a method of transferring a preformed container by a transferring method.

The indicating process for indicating the measurement data (weight) on the capping film is not limited to be provided by a method of directly printing the product information including the measurement value on the capping film with a printer as shown in the drawing. It can also be provided by other methods, such as, for example, printing the product information including the measurement valued on a label and sticking the label on the capping film. The control of causing the container containing the package item and the capping film on which the product information including the measurement data of the package item can be accomplished by either a method of thermal sealing the indicated capping film to the container and intermittently transfer the capping film in coordination with the intermittent transfer of the container (synchronous transfer), or a method of transferring the container and the capping film asynchronously. Establishing the correspondence between the measurement data (weight) and the container (position) can be accomplished either by assigning the container (position) to which the measured package item to be loaded, or by using the sensor number of the package item detection unit I which detect the loading of the package item.

A thermal sealing packaging system according to the present invention is not limited to the embodiments described herein with reference to the drawings, it can be modified within the range of not exceeding the gist of the invention pursuant to the following non-limiting examples. (1) The measurement unit (scale) for measuring the weight of the package item is not limited to one, but can be several (e.g., two), and the location of installation of measuring means does not have to be above the container molding unit provided on the container transfer line; for example, it can be installed on the side of the container transfer line, or other suitable locations. (2) The assignment of containers for loading them with measured package items can be done, in addition to LED lighting or shutter control as shown in the drawings, with a color coordination method by coloring a plurality of measurement units (scales) with various colors as well as a plurality of lamps (LED) in colors matching with those of measurement units (scales). For example, it can be constituted in such a way that a package item measured by a red measurement unit is loaded into a container lighted by a red lamp (LED) while a package item measured by a green measurement unit is loaded into a container lighted by a green lamp (LED). (3) Although it was described in the aforementioned embodiments that the capping film is thermally sealed on the container film and the capping film is transferred together with the container film as the latter is transferred, the same effect can be achieved by transferring the capping film and the container film with separate drive means and synchronizing the two drive means. (4) It can also be achieved by providing marks at a specific interval denoting one step transfer of the capping film on an edge of the width direction of the capping film, and controlling the transfer of the capping film by detecting the marks with a sensor provided in the vicinity of the feed of the capping film. (5) Although the aforementioned embodiments showed that the containers are molded on the container film in the container molding unit while the container film is being transferred, it can also be constituted to transfer preformed containers by a container transfer unit. (6) Although the packaging process in the sealing unit has been described as a air-filled type packaging in the aforementioned embodiments, a vacuum packaging or gas-filled packaging can be used as well. (7) Although it has been described with reference to the flowchart shown in FIG. 11 of the aforementioned embodiments that the program advances to S27 when the measurement value of the weighing dish is "0" in S26 and the LED turn-off signal is transmitted to the packaging machine in S27, it can also be constituted to leave the lighted LED as is and send the LED turn-on signal to the packaging machine to turn on the LED of the next assignment in lieu of S23 when the measurement value of the weighing dish is "0" in S26. It can also be constituted to turn off the lighted LED, and send the LED turn-on signal to the packaging machine in lieu of S23. In other words, the system is configured to execute the next process when it is judged that the measurement value of the weighing dish is "0" in S26 and that the package item is loaded into the assigned container. The "next process" here means, for example, turning off the lighted LED, or transmitting the LED turn-on signal to the packaging machine to turn on the LED of the next assignment in lieu of S23 while leaving the lighted LED as is. It can also be turning off the lighted LED and sending the LED turn-on signal to the packaging machine in lieu of S23, or transferring the capping film and the container film for one step. (8) Although it has been described in the aforementioned embodiments that the second time film transfer is executed without waiting for the printing for the loaded W1 and W2 in the first time film transfer in the flowchart of FIG. 10, it can also be constituted in such a way as to print for W1 and W2 as soon as the loading of W1 and W2 is finished, and then execute the second time film transfer. For example, if in case two containers W1 and W2 exist in the film width direction as in the aforementioned embodiment, the first package item is measured and loaded into the assigned container, and the second package item is measured and loaded into the assigned container, i.e., when the loading of the two package items finish, the measurement data for both items are printed, the film is transferred, and package items are loaded into the next containers. In other words, it can be constituted in such a way as to transfer the film for one step after completing measurement, loading and printing for one step of the film transfer. In such a case, however, it is necessary to place the indication means G shown in FIG. 1 one step upstream side of the film. (9) Although it has been described in the aforementioned embodiments that weights and product names are printed on the film, it can also be constituted to have the same contents as shown in FIG. 5 to be printed on a label and stick the label on the capping film by an applicator, etc. In this case, starting with the label to be sticked on the container of LED number 1, the data including weight and product name corresponding to each LED number received by the printer 17 are printed. The printed label is then sucked up and held by an applicator, built like a robot arm, and sticked on the specified position. The sticking position is defined by predetermining the sticking position coordinate information based on the X-Y coordinate system as described before for printing, and the applicator moves to the coordinate position placing the glued surface of the label on the capping film to paste the label. When sticking for the LED number 1 is finished, the label for the LED number 2 is printed similar to the LED number 1 and the applicator moves in accordance to the sticking position coordinate information to stick the label. (10) Although the information printed on the capping film in case of the aforementioned embodiment was described as weight, price, unit price and product name in case of the embodiment, it can include bar code, graphics, image data and others as well. (11) Although the aforementioned embodiment included the package item detection unit, such a detection unit does not necessarily have to be provided but rather the system can be constituted to have only a container assignment unit provided for each container.

What is claimed is:

1. A thermal sealing packaging system comprising:

a container transfer unit for transferring a container adapted for being loaded with a package item;

a measuring unit configured to measure the weight of the package item before the package item is loaded into the container;

a capping film supply unit that supplies a capping film adapted for covering an opening area of the container;

a printing apparatus adapted to print measurement data of the package item measured by the measuring unit on the capping film before the capping film is positioned to cover the opening area of the container;

a sealing unit adapted to thermally seal the opening area of the container with the capping film after the package item has been loaded into the opening area;

a package item detection unit that detects whether or not a container is loaded with a package item, the package item detection unit being arranged in the vicinity of the container detection unit; and a controller that controls the thermal sealing packaging system in such a way that the opening area of the container into which the package item is loaded is covered by the capping film with corresponding measurement data being previously printed on the capping film, the controller further controls the thermal sealing packaging system in a way such that the next process is executed only when it is detected that the entire amount of the package item arranged on the measuring unit is removed in addition to the loading of the package item into the container detected by the package item detection unit.

2. The thermal sealing packaging system according to claim 1, comprising a supply unit that loads the measured package item into the container, the supply unit adapted to receive a plurality of containers from the container transfer unit and being provided with a container assignment unit that assigns a particular container for the measured packaged item to be loaded therein, the supply unit adapted to store printing position information useable for printing the measurement data on the capping film in correspondence with each container assignment unit.

3. The thermal sealing packaging system according to claim 1, wherein a plurality of package item detection units are installed and identified individually, storing measurement data outputted by the measurement unit in conjunction with the container detection information from the identified package item detection unit.

4. The thermal seal packaging system according to claim 1, further comprising an error reporting unit for reporting an error when the package item is loaded mistakenly into a container different from the container assigned by the container assignment unit.

5. The thermal seal packaging system according to claim 1, wherein the controller controls the packaging system in a way that the transfer of the container by the container transfer unit and the supply of the capping film by the capping film supply unit are intermittently driven, and the printing on the capping film by the printing apparatus is executed when the container is stopped to be loaded with the package item from the supply unit.

6. A thermal sealing packaging system comprising:

a container transfer unit for transferring a container adapted for being loaded with a package item;

a measuring unit configured to measure the weight of the package item before the package item is loaded into the container;

a supply unit that loads the measured package item into the container, the supply unit adapted to receive a plurality of containers from the container transfer unit and being provided with a container assignment unit that assigns a particular container for the measured packaged item to be loaded therein, the supply unit adapted to store printing position information useable for printing the measurement data on the capping film in correspondence with each container assignment unit;

a capping film supply unit that supplies a capping film adapted for covering an opening area of the container;

a printing apparatus adapted to print measurement data of the package item measured by the measuring unit on the capping film before the capping film is positioned to cover the opening area of the container;

a sealing unit adapted to thermally seal the opening area of the container with the capping film after the package item has been loaded into the opening area;

a package item detection unit that detects whether or not a container is loaded with a package item, the package item detection unit being arranged in the vicinity of the container detection unit; and a controller that controls the thermal sealing packaging system in such a way that the opening area of the container into which the package item is loaded is covered by the capping film with corresponding measurement data being previously printed on the capping film, the controller further controls the thermal sealing packaging system in a way such that the next process is executed only when it is detected that the entire amount of the package item arranged on the measuring unit is removed in addition to the loading of the package item into the container detected by the package item detection unit.

7. The thermal sealing packaging system according to claim 6, wherein a plurality of package item detection units are installed and identified individually, storing measurement data outputted by the measurement unit in conjunction with the container detection information from the identified package item detection unit.

8. The thermal seal packaging system according to claim 6, further comprising an error reporting unit for reporting an error when the package item is loaded mistakenly into a container different from the container assigned by the container assignment unit.

9. The thermal seal packaging system according to claim 6, wherein the controller controls the packaging system in a way that the transfer of the container by the container transfer unit and the supply of the capping film by the capping film supply unit are intermittently driven, and the printing on the capping film by the printing apparatus is executed when the container is stopped to be loaded with the package item from the supply unit.

* * * * *